US009876289B2

(12) United States Patent
Endo et al.

(10) Patent No.: US 9,876,289 B2
(45) Date of Patent: Jan. 23, 2018

(54) TERMINAL METAL FITTING AND CONNECTOR USING SAME

(71) Applicants: DAI-ICHI SEIKO CO., LTD., Kyoto (JP); KOITO MANUFACTURING CO., LTD., Tokyo (JP)

(72) Inventors: Takayoshi Endo, Shizuoka (JP); Takehiko Osuga, Shizuoka (JP); Masaya Muta, Shizuoka (JP); Shigehiko Kazaoka, Shizuoka (JP); Kohei Yamaguchi, Shizuoka (JP)

(73) Assignees: DAI-ICHI SEIKO CO., LTD. (JP); KOITO MANUFACTURING CO., LTD. (JP)

( * ) Notice: Subject to any disclaimer, the term of this patent is extended or adjusted under 35 U.S.C. 154(b) by 0 days.

(21) Appl. No.: 15/282,769

(22) Filed: Sep. 30, 2016

(65) Prior Publication Data

US 2017/0110809 A1 Apr. 20, 2017

(30) Foreign Application Priority Data

Oct. 20, 2015 (JP) ..... 2015-206645

(51) Int. Cl.
*H01R 12/91* (2011.01)
*H01R 9/22* (2006.01)
(Continued)

(52) U.S. Cl.
CPC ..... *H01R 9/223* (2013.01); *H01R 12/91* (2013.01); *H01R 13/055* (2013.01);
(Continued)

(58) Field of Classification Search
CPC .... H01R 12/91; H01R 13/113; H01R 13/055; H01R 13/04; H01R 13/6315; H01R 9/223
(Continued)

(56) References Cited

U.S. PATENT DOCUMENTS 4,351,582 A 9/1982 Emerson et al. ..... H01R 4/24
5,591,054 A * 1/1997 Okada ..... H01R 13/04 439/884

(Continued)

FOREIGN PATENT DOCUMENTS

EP 2903096 8/2015 ..... H01R 13/41
GB 2188497 0/1897 ..... H01R 13/00

(Continued)

OTHER PUBLICATIONS

Korean Office Action issued in application 10-2016-0128283, dated Aug. 17, 2017 (12 pgs).

(Continued)

*Primary Examiner* — Felix O Figueroa
(74) *Attorney, Agent, or Firm* — Hayes Soloway P.C.

(57) ABSTRACT

A terminal metal fitting, includes: a first terminal extended in a first direction on a first plane; a second terminal extended in a second direction on the first plane; a first flat plate part of a flat plate type, the first flat plate part being contacted with the first terminal, and having a first broad width face parallel to the first plane; a second flat plate part of a flat plate type, the second flat plate part being contacted with the second terminal, and having a second broad width face parallel to the first plane; a first articulated part of a flat plate type, the first articulated part being contacted with the first flat plate part in the first direction, and having a third broad width face parallel to a second plane including a third direction perpendicular to the first plane, and the first direction; a second articulated part of a flat plate type, the second articulated part being contacted with the second flat plate part in the second direction, and having a fourth broad width face parallel to a third plane including the second direction and the third direction; and a connecting portion connecting the first articulated part and the second articulated part, wherein the connection portion can be bent (Continued)

around the third direction to form an angle difference between the first direction and the second direction.

11 Claims, 22 Drawing Sheets

(51) Int. Cl.
*H01R 13/05* (2006.01)
*H01R 13/11* (2006.01)
*H01R 13/631* (2006.01)
*H01R 13/04* (2006.01)

(52) U.S. Cl.
CPC ..... *H01R 13/113* (2013.01); *H01R 13/6315* (2013.01); *H01R 13/04* (2013.01)

(58) Field of Classification Search
USPC ..... 439/246–248
See application file for complete search history.

(56) References Cited

U.S. PATENT DOCUMENTS

| | | | | |
|---|---|---|---|---|
| 5,888,096 | A | 3/1999 | Soes et al. | 439/610 |
| 6,529,113 | B2 * | 3/2003 | Endo | H01H 85/0417 439/843 |
| 8,025,538 | B2 | 9/2011 | Hara et al. | 439/723 |
| 8,672,718 | B2 * | 3/2014 | Suzuki | H01R 12/57 439/876 |
| 2014/0087592 | A1 | 3/2014 | Endo et al. | H01R 13/46 |
| 2016/0028178 | A1 | 1/2016 | Lee | H01R 13/405 |

FOREIGN PATENT DOCUMENTS

| | | | |
|---|---|---|---|
| JP | H03004665 | 1/1991 | H01R 9/09 |
| JP | 2004363024 | 12/2004 | H01R 4/24 |
| JP | 2005108492 | 4/2005 | H01R 43/16 |
| JP | 2005129390 | 5/2005 | H01R 13/115 |
| JP | 2011103193 | 5/2011 | H01R 31/08 |
| JP | 2013089388 | 5/2013 | H01R 13/14 |
| JP | 2014011079 | 1/2014 | H01R 12/71 |
| JP | 2017011079 | 1/2014 | H01R 12/71 |
| KR | 100327159 | 8/2002 | H01R 43/24 |
| TW | M499687 | 4/2015 | H01R 13/62 |
| WO | WO 95/20252 | 7/1995 | H01R 43/24 |

OTHER PUBLICATIONS

European Search Report issued in application No. 16190128.5, dated Jun. 28, 2017 (14 pgs).

Japanese Office Action (w/translation) issued in application No. 2015-206645 dated Feb. 28, 2017 (9 pgs).

European Patent Office Search Report Issued in Corresponding Application No. 16190128.5 dated Mar. 17, 2017 (7 Pages).

* cited by examiner

TERMINAL METAL FITTING AND CONNECTOR USING SAME

BACKGROUND OF THE INVENTION

1. Field of the Invention

The present invention relates to a terminal metal fitting and a connector using the same which are used for electrically connecting various devices mounted on such as an automobile or the like.

2. Description of the Related Art

As terminal metal fittings including terminals at both ends thereof, devices disclosed in Reference 1 (Japanese patent application Laid-open on No. 2013-89388) have been known, for example.

As shown in FIG. 32, a terminal metal fitting 110 includes: a male terminal 111 having a first fitting direction X toward a mating female terminal; another female terminal 112 having a second fitting direction Z toward another mating male terminal; and a connecting member 114 bent in a shape of L on an X-Z plane.

The connecting member 114 includes: a first liner part 114A extending from a curved part 114C in the direction X to be directly connected to the male terminal 111 at the distal end thereof; and a second liner part 114B extending from the curved part 114C in the direction Z to be directly connected to the other female terminal 112 at the distal end thereof.

Reference 1 also discloses that all members from the male terminal 111 via the connecting member 114 to the female terminal 112 are formed by bending a sheet of a metal plate.

Reference 1, however, is silent regarding how to bend the members in a shape of L at the curved part 114C concretely.

Reference 1 also recites that a part from the first liner part 114A to the middle of the second liner part 114B is configured with a thin band plate.

REFERENCES

Reference 1: Japanese patent application Laid-open on No. 2013-89388

OBJECTS AND SUMMARY OF THE INVENTION

The curved part 114C of the terminal metal fitting 110 disclosed in Reference 1 seems to be formed by bending a boundary part between the first liner part 114A configured with the thin band plate and the second liner part 114B to form the shape of L.

However, it is difficult to bend the above-mentioned boundary part between the first liner part 114A and the second liner part 114B precisely in position.

This is because the portion between the first liner part 114A and the second liner part 114B is uniformly configured with the same thin band plate, and any positions of the portion can be bent in the same manner.

In view of the above, an object of the present invention is to provide a terminal metal fitting having terminals at the both ends, capable of being easily bent precisely in position to be bent, and a connector using the same.

A terminal metal fitting according to the present invention, comprises: a first terminal extended in a first direction on a first plane; a second terminal extended in a second direction on the first plane; a first flat plate part of a flat plate type, the first flat plate part being contacted with the first terminal, and having a first broad width face parallel to the first plane; a second flat plate part of a flat plate type, the second flat plate part being contacted with the second terminal, and having a second broad width face parallel to the first plane; a first articulated part of a flat plate type, the first articulated part being contacted with the first flat plate part in the first direction, and having a third broad width face parallel to a second plane including a third direction perpendicular to the first plane, and the first direction; a second articulated part of a flat plate type, the second articulated part being contacted with the second flat plate part in the second direction, and having a fourth broad width face parallel to a third plane including the second direction and the third direction; and a connecting portion connecting the first articulated part and the second articulated part, wherein the connection portion can be bent around the third direction to form an angle difference between the first direction and the second direction.

With this structure, upon bending the terminal metal fitting according to the present invention around the third direction (i.e., perpendicularly to the first plane), the first flat plate part (having the first broad width face parallel to the first plane) regulates bending of the first articulated part, and the second flat plate part (having the second broad width face parallel to the first plane) regulates bending of the second articulated part.

This leads not to bend the first and second articulated parts but to bend the connecting portion connecting the first and second articulated parts.

If external force around at least one of the first and second directions is applied onto at least one of the first and second articulated parts of the terminal metal fitting according to the present invention, the first flat plate part regulates the bending of the first articulated part, and the second flat plate part regulates the bending of the second articulated part, respectively. Therefore, neither the first articulated part nor the second articulated part twists.

Preferably, a width of the connecting portion in the third direction is narrower than both a width of the first articulated part in the third direction, and a width of the second articulated part in the third direction.

With this structure, upon bending force around the third direction acting onto the fitting, the connecting portion becomes easier to be bent than the first articulated part and the second articulated part.

It is preferable that a plate thickness of the connecting portion is thinner than both a plate thickness of the first articulated part, and a plate thickness of the second articulated part.

With this structure, upon bending force around the third direction acting onto the fitting, the connecting portion becomes easier to be bent than the first articulated part and the second articulated part.

As for the terminal metal fitting according to the present invention, it is preferable that each of the first, second, third, and fourth broad width faces of the first flat plate part, the first articulated part, the second flat plate part, and the second articulated part except the connecting portion includes an embossed section formed by embossing each of the first, second, third, and fourth broad width faces in the respective plate thickness directions thereof.

With this structure, upon bending force around the third direction acting onto the fitting, the connecting portion becomes easier to be bent than the first flat plate part, the first articulated part, the second flat plate part, and the second articulated part.

As for the terminal metal fitting according to the present invention, it is preferable that on the first plane of the first terminal, the first articulated part is on a central line of a width in a fourth direction perpendicular to the first direction; and that on the first plane of the second terminal, the second articulated part is on a central line of a width in a fifth direction perpendicular to the second direction.

With this arrangement, the connecting portion of the terminal metal fitting according to the present invention can be bent in one and another direction around the third direction so as to form angle differences between the first and second directions.

If the formed angle differences in the cases of the one and the other directions are the same, a second distal end position of the second terminal based on a first distal end position of the first terminal is linearly symmetrical with a central line of a width of the first terminal in the fourth direction.

A connector according to the present invention may comprise: the above-mentioned terminal metal fitting; and a housing storing the terminal metal fitting therein.

This arrangement enables to obtain the connector wherein the housing therein stores the terminal metal fitting equipped with an angle difference between extending directions of the first and second terminals.

It is preferable that the terminal metal fitting includes: a first engaging portion engaged with the housing on the first terminal; and a second engaging portion engaged with the housing on the second terminal, respectively; the housing comprising: a first housing portion, upon the first terminal having been inserted into the first housing portion in the first direction, storing the first terminal of the terminal metal fitting so as to entirely hide thereof, and the first housing portion including a first engaged portion engaged with a first engaging portion of the first terminal; a second housing portion storing the second terminal of the terminal metal fitting so as to hide a part of the second terminal, and the second housing portion including a second engaged portion engaged with a part of the second engaging portion of the second terminal; and a cover covering the second terminal exposed from the second housing portion, and the cover clamping the second engaging portion of the second terminal with the second engaged portion to hold the second engaging portion of the second terminal.

In the connector according to the present invention, the first terminal of the terminal metal fitting may be inserted in the first direction into the first housing portion of the housing. And then, the first engaging portion of the first terminal may be engaged with the first engaged portion of the first housing portion.

A part of the second terminal of the terminal metal fitting may be stored into the second housing portion of the housing. And then, a part of the second engaging portion of the second terminal may be engaged with the second engaged portion of the second housing portion.

Furthermore, the cover may cover the second terminal exposed from the second housing portion. And then, the cover may clamp the second engaging portion of the second terminal with the second engaged portion, thereby the second engaging portion of the second terminal may be held.

The housing may be configured so as to therein store a plurality of devices arranged in the third direction, each of the plurality of devices being the terminal metal fitting. Particularly as already stated, in the terminal metal fitting, on the first plane of the first terminal, the first articulated part is on the central line of the width in the fourth direction perpendicular to the first direction; and on the first plane of the second terminal, the second articulated part is on the central line of the width in the fifth direction perpendicular to the second direction.

By means of the terminal metal fitting, the connecting portion can be bent in the one and the other directions around the third direction so as to form the angle differences between the first and second directions. If the formed angle differences in the cases of the one and the other directions are the same, the second distal end position of the second terminal based on the first distal end position of the first terminal is linearly symmetrical with the central line of the width of the first terminal in the fourth direction.

Regardless of the one and the other directions around the third direction in which the connecting portion is bent, if the plurality of terminal metal fittings are arranged in the third direction to be stored in the housing such that the plurality of terminal metal fittings are bent in the same direction, the second distal end positions of the second terminals can have the same positions based on the first distal end positions of the first terminals.

It is preferable that a pressing part is provided with the first terminal of the terminal metal fitting, the pressing part, upon inserting the first terminal into the first housing portion, pressing the first terminal in the first direction.

With this arrangement, when the pressing part is pressed in the first direction, pressing force upon inserting the terminal metal fitting into the first housing portion is applied onto the first terminal, thereby enabling to prevent the connecting portion from being deformed.

[Effect of Invention]

(1) According to the terminal metal fitting according to the present invention, not the first articulated part and the second articulated part but the connecting portion connecting the first articulated part and the second articulated part is bent. The terminal metal fitting can be easily bent at the connecting portion to be bent.

In the terminal metal fitting according to the present invention, neither the first articulated part nor the second articulated part is twisted even if external force around the first and/or the second directions/direction is applied onto the first articulated part and/or the second articulated part. Accordingly, postures of the first terminal and the second terminal are maintained.

(2) On the first plane of the first terminal, the first articulated part is on the central line of the width in the fourth direction perpendicular to the first direction; and on the first plane of the second terminal, the second articulated part is on the central line of the width in the fifth direction perpendicular to the second direction.

Regardless of the one and the other bending directions around the third direction, the second distal end positions of the second terminals can have the same positions based on the first distal end positions of the first terminals. Particularly in the case where the plurality of terminal metal fittings are arranged in the third direction to be stored in the housing, the plurality of terminal metal fitting can be communalized.

(3) Combination of the above-mentioned terminal metal fitting and the connector including the housing storing the terminal metal fitting therein can provide a connector storing the terminal metal fitting having the angle difference between the extending directions of the first and second terminals in the housing.

(4) In the connector according to the present invention, when the terminal metal fitting is stored into the first and second housing portions of the housing, the first and second engaging portions of the terminal metal fitting are engaged with the first engaged portion of the first housing portion and the second engaged portion of the second housing portion, respectively, and the cover holds the second engaging portion of the second terminal. Accordingly, a connector capable of being easily assembled can be obtained.

(5) Since the pressing part is provided with the first terminal of the terminal metal fitting, the pressing part, upon inserting the first terminal into the first housing portion, pressing the first terminal in the first direction, the pressing force is prevented from being applied onto the connecting portion upon the inserting.

Accordingly, the connecting portion can be prevented from being deformed.

DETAILED DESCRIPTION OF THE PREFERRED EMBODIMENTS (Embodiment 1)

First, a terminal metal fitting in an Embodiment according to the present invention will now be explained.

Figure 1:
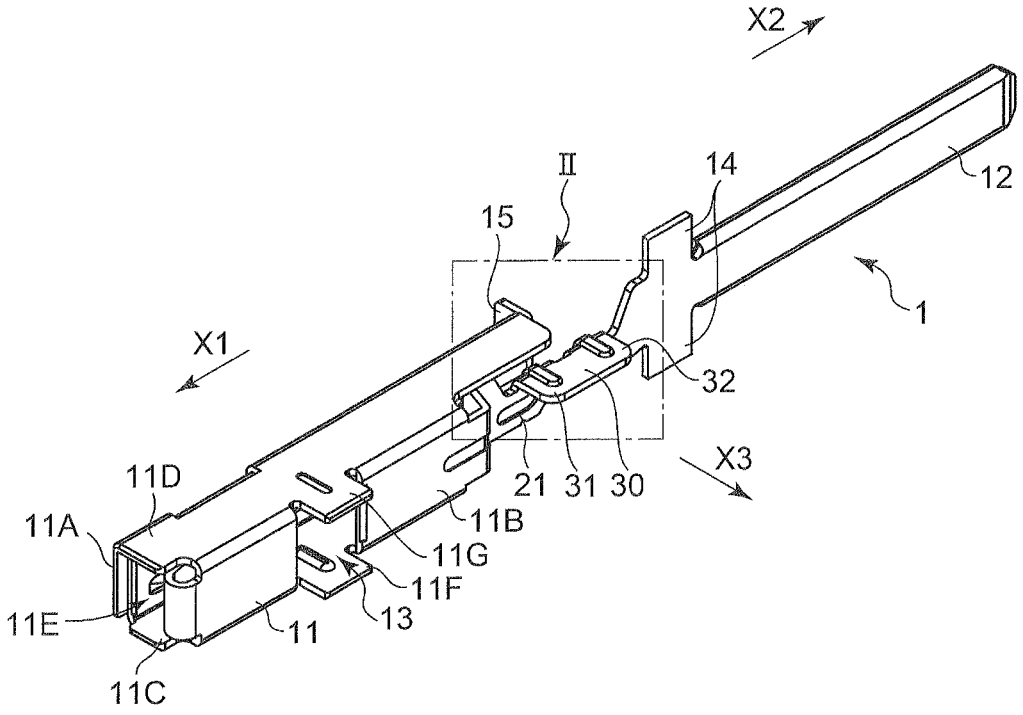
FIG. 1 is a perspective view of a terminal metal fitting (before being bent) in an Embodiment according to the present invention.
Figure 2:
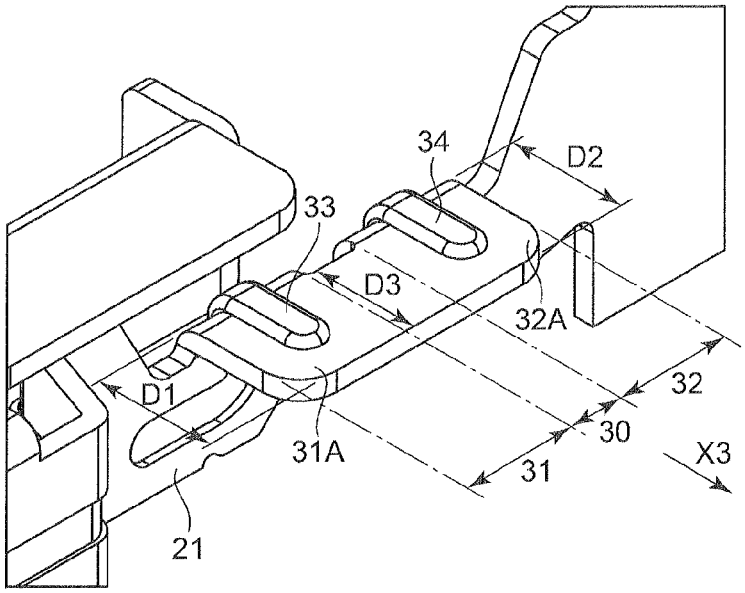
FIG. 2 is an enlarged view of the II section in FIG. 1.
Figure 3:
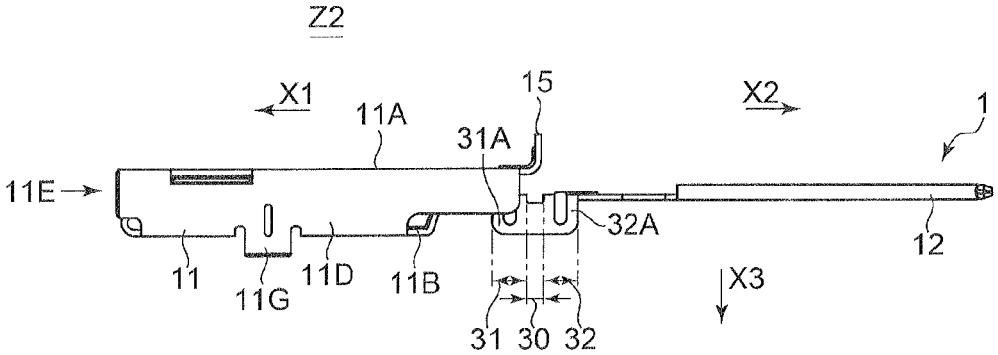
FIG. 3 is a ground plan of the terminal metal fitting of FIG. 1.
Figure 4:
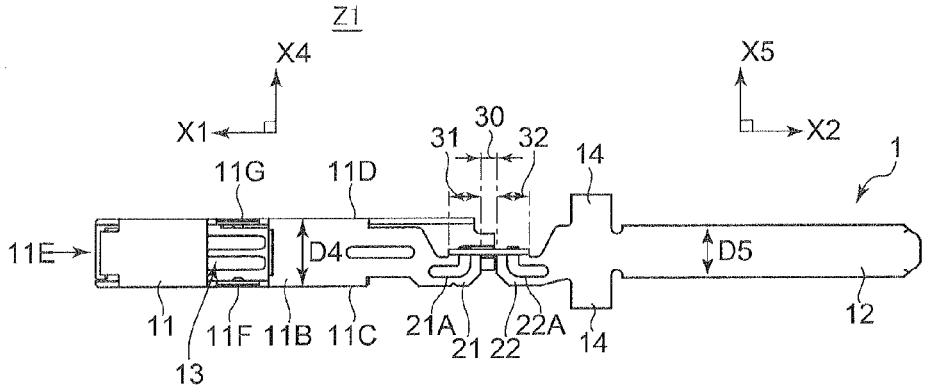
FIG. 4 is a front view of the terminal metal fitting of FIG. 1.
Figure 5:
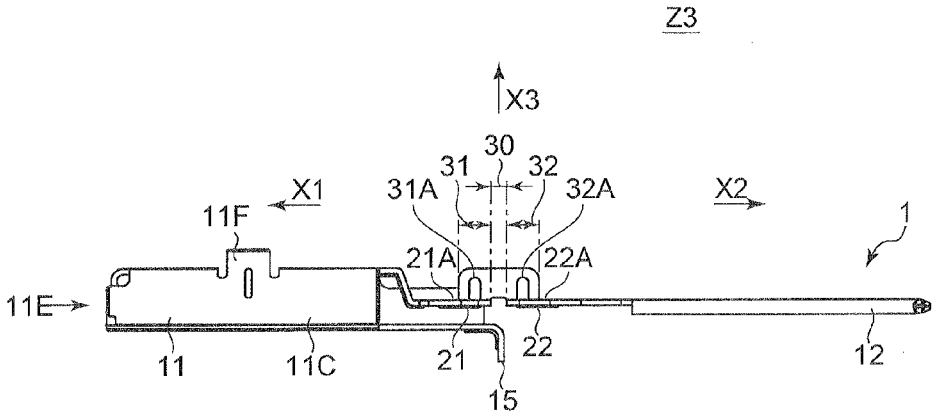
FIG. 5 is a bottom view of the terminal metal fitting of FIG. 1.
Figure 6:
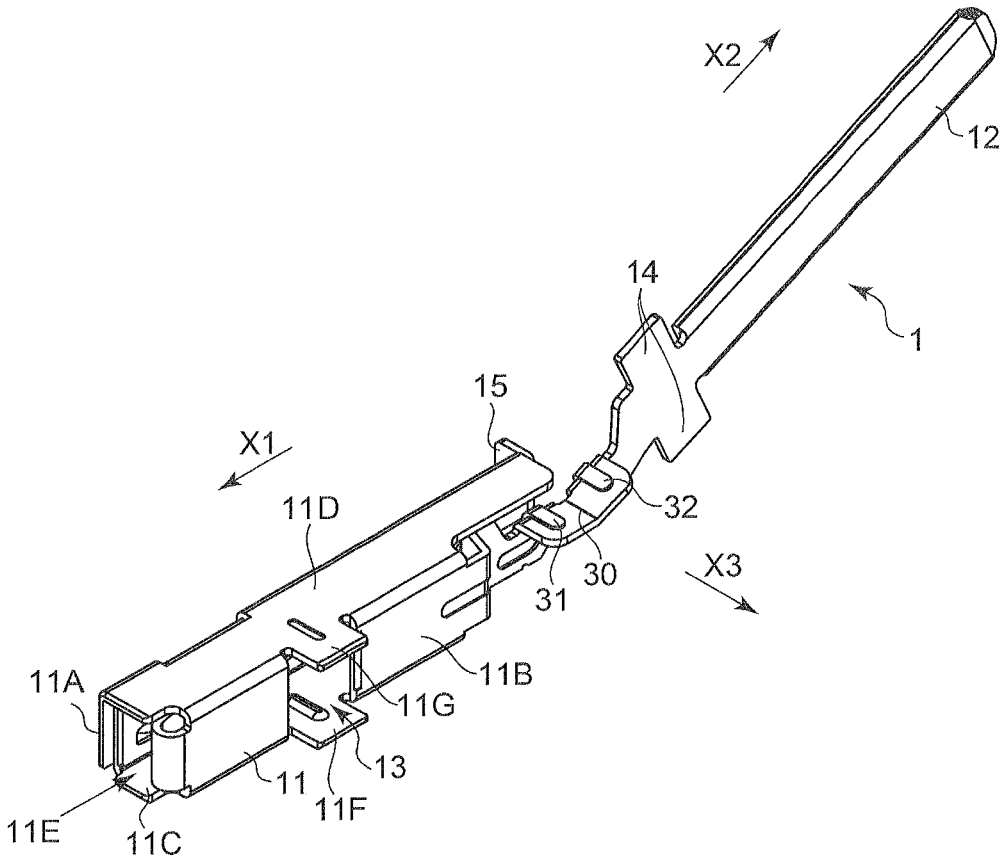
FIG. 6 is a perspective view of the bent terminal metal fitting (after having been bent) of FIG. 1.
Figure 7:
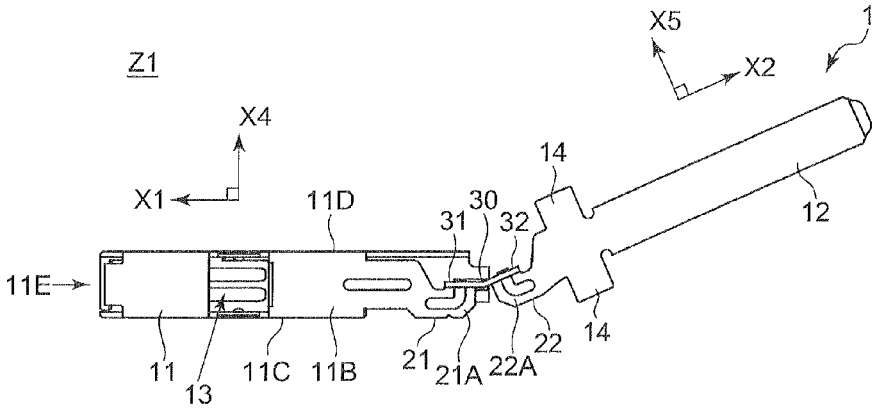
FIG. 7 is a front view of the terminal metal fitting of FIG. 6.
Figure 8:
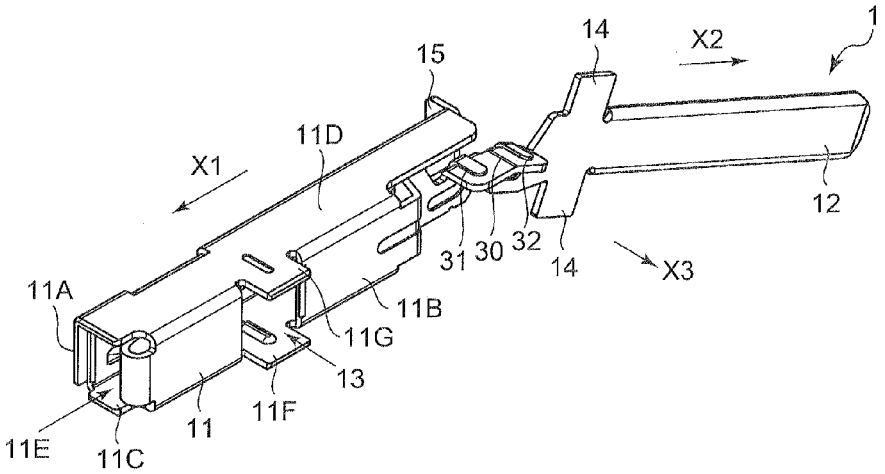
FIG. 8 is a perspective view of the terminal metal fitting of FIG. 1 after having bent in a direction opposite to that of FIG. 6.
Figure 9:
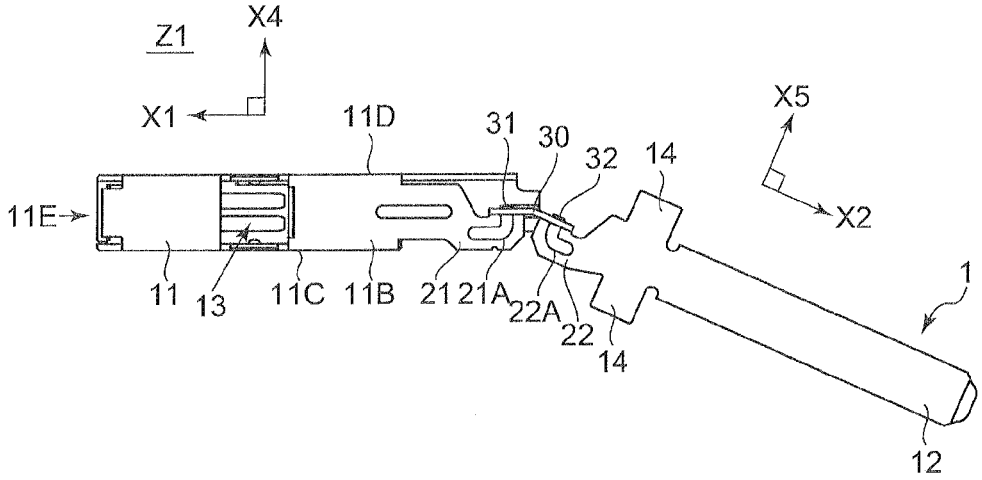
FIG. 9 is a front view of the terminal metal fitting of FIG. 8.
Figure 10:
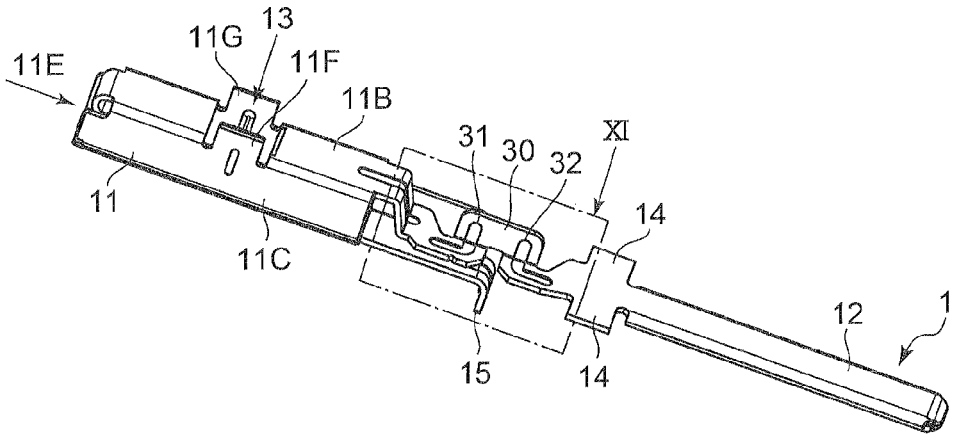
FIG. 10 is a perspective and upward view of the terminal metal fitting of FIG. 1.
Figure 11:
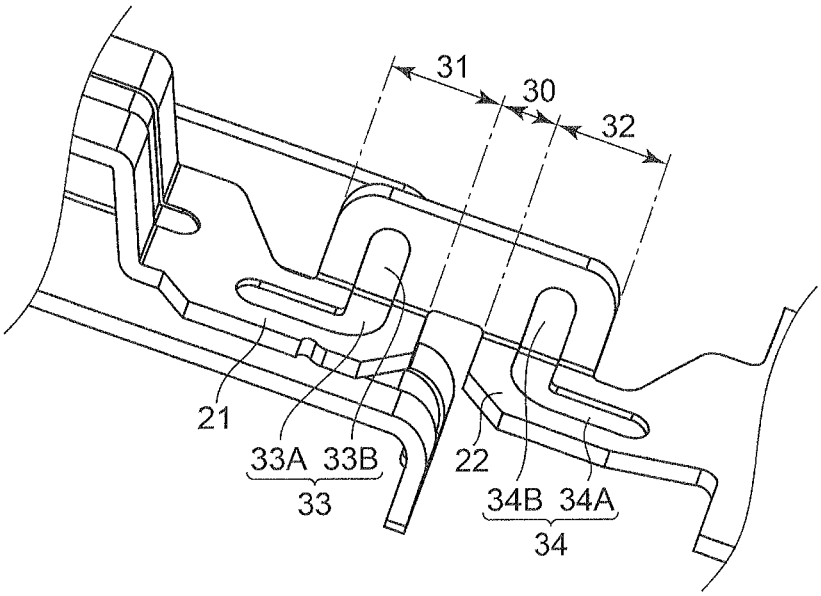
FIG. 11 is an enlarged view of the XI section in FIG. 10.

FIG. 1 is a perspective view of a terminal metal fitting (before being bent) in an Embodiment according to the present invention; FIG. 2 is an enlarged view of the II section in FIG. 1; FIG. 3 is a ground plan of the terminal metal fitting of FIG. 1; FIG. 4 is a front view of the terminal metal fitting of FIG. 1; FIG. 5 is a bottom view of the terminal metal fitting of FIG. 1; FIG. 6 is a perspective view of the bent terminal metal fitting (after having been bent) of FIG. 1; FIG. 7 is a front view of the terminal metal fitting of FIG. 6; FIG. 8 is a perspective view of the terminal metal fitting of FIG. 1 after having bent in a direction opposite to that of FIG. 6; FIG. 9 is a front view of the terminal metal fitting of FIG. 8; FIG. 10 is a perspective and upward view of the terminal metal fitting of FIG. 1; and FIG. 11 is an enlarged view of the XI section in FIG. 10.

As shown in from FIG. 1 to FIG. 7, a terminal metal fitting 1 in the Embodiment according to the present invention comprises: a first terminal 11 extended in a first direction X1 on a first plane Z1 (See, FIG. 4 and FIG. 7); and a second terminal 12 extended in a second direction X2 on the first plane Z1.

As shown in FIG. 1, in this Embodiment, when the terminal metal fitting 1 has not yet been bent, the first direction X1 and the second direction X2 are parallel to each other. And, as shown in FIG. 7 and FIG. 9, after the terminal metal fitting 1 has been bent, there is an angle difference between the first direction X1 and the second direction X2.

The first terminal 11 is formed, for example, by bending a flat metal plate.

The first terminal 11 is a male terminal constituted with a cylindrical body having: a top plate 11A; a bottom plate 11B; and a pair of wall plates 11C and 11D contacting with end portions of the top plate 11A and the bottom plate 11B. The cylindrical body further has a rectangle opening 11E into which a male terminal (not shown) is inserted. Each of the top plate 11A, the bottom plate 11B, and the wall plates 11C and 11D is of a flat plate type.

In this Embodiment, the male terminal to be inserted into the first terminal 11 is band-like shaped to include a broad width face parallel to the first plane Z1, similar to the second terminal 12 mentioned below.

A recessed portion 13 is formed on the first terminal 11 as a first engaging portion engaged with a housing 3 mentioned below.

The recessed portion 13 is an opening formed on the bottom plate 11B, i.e., an opening formed toward a third direction X3 of the first terminal 11.

Moreover, at positions of the recessed portions 13, 13 of the wall plates 11C and 11D, plate-like shaped protrusion plates 11F and 11G projecting in a substantially vertical direction from the bottom plate 11B are provided, respectively.

Furthermore, a plate-like shaped pressing part 15 is provided with the top plate 11A. The pressing part 15 projects in a substantially vertical direction from the top plate 11A, that is, in a direction perpendicular to the first direction X1.

An end portion of the bottom plate 11B at a side for the second terminal 12 is bent to have a bent portion toward the top plate 11A, and a distal end of the bent portion is contacted with a first flat plate part 21.

The first flat plate part 21 includes a broad width face 21A parallel to the top plate 11A of the first terminal 11, that is, parallel to the first plane Z1.

As shown in FIG. 4, the broad width face 21A of the first flat plate part 21 has an approximately half width of a width D4 of the bottom plate 11B of the first terminal 11. One side edge of the broad width face 21A toward a −X4 direction extends along the wall plate 11C located toward the −X4 direction.

According to this structure, another side edge of the broad width face 21A facing along a +X4 direction is positioned near a central line of the bottom plate 11B of the first terminal 11.

As shown in FIG. 4, the second terminal 12 is a male terminal to be inserted into a female terminal (not shown). The second terminal 12 is band-like shaped to have a width D5, and includes a broad width face parallel to the first plane Z1.

Projection portions 14, 14 are formed on the second terminal 12 as second engaging portions engaged with the housing 3 mentioned below.

The projection portions 14, 14 are flat plates each having a broad width face parallel to the first plane Z1, and project on the first plane Z1 of the second terminal 12 both up-and-down directions of the fifth direction X5 perpendicular to the second direction X2.

A second plate-like shaped flat plate part 22 is contacted with an end portion of the projection portions 14, 14 toward the first terminal 11. The second flat plate part 22 includes a broad width face 22A parallel to a broad width face of the second terminal 12, that is, parallel to the first plane Z1.

As shown in FIG. 4, the broad width face 22A of the second flat plate part 22 has the width D4, which is an approximately half of that of the bottom plate 11B of the first terminal 11, and an end portion toward a +X5 direction is positioned near a central line of the width D5 of the second terminal 12.

A first articulated part 31 including a broad width face 31A extending in the first direction X1 is contacted with an end portion toward the +X4 direction on the broad width face 21 A of the first flat plate part 21.

The broad width face 31A is parallel to the wall plates 11C and 11D of the first terminal 11, that is, parallel to a second plane Z2 including both the third direction X3 perpendicular to the first plane Z1 and the first direction X1.

As shown in FIG. 5, the broad width face 31A has an approximately half width of that of the wall plate 11C of the first terminal 11.

On the other hand, a second articulated part 32 including a broad width face 32A extending in the second direction X2 is contacted with an end portion toward the +X5 direction on the broad width face 22A of the second flat plate part 22.

The broad width face 32A is perpendicular to the broad width face of the second terminal 12, that is, parallel to a third plane Z3 including both the second direction X2 and the third direction X3.

As shown in FIG. 5, the broad width face 32A has an approximately half width of that of the wall plate 11C of the first terminal 11.

The first articulated part 31 and the second articulated part 32 are connected by a connecting portion 30.

The connecting portion 30 is formed on a portion extended from both the broad width face 31A parallel to the second level Z2 of the first articulated part 31, and the broad width face 32A parallel to the third plane Z3 of the second articulated part 32.

Herein, the connecting portion 30 is not directly connected to the first flat plate part 21 and the second flat plate part 22. In addition, the connecting portion 30 can be bent around the third direction X3 so as to form an angle difference between the first direction X1 and the second direction X2 (See, from FIG. 6 to FIG. 9).

The first flat plate part 21, the first articulated part 31, the connecting portion 30, the second articulated part 32, and the second flat plate part 22 are formed by shaping a flat plate including areas for the above together with the first and second terminals 11, 12, and then bending the first articulated part 31, the connecting portion 30, and the second articulated part 32 by 90 degrees toward the third direction X3.

In the terminal metal fitting 1 above-constructed, upon bending the connecting portion 30 around the third direction X3 (i.e., perpendicularly to the first plane Z1), the first flat plate part 21 (having the first broad width face 21A parallel to the first plane Z1) regulates bending of the first articulated part 31, and the second flat plate part 22 (having the second broad width face 22A parallel to the first plane Z1) regulates bending of the second articulated part 32.

Therefore, as shown in from FIG. 6 to FIG. 9, this leads not to bend the first and second articulated parts 31, 32 but to bend the connecting portion 30 connecting the first and second articulated parts 31, 32.

In the terminal metal fitting 1 above-constructed, if external force around at least one of the first and second directions X1, X2 is applied onto at least one of the first and second articulated parts 31, 32, the first flat plate part 21 regulates the bending of the first articulated part 31, and the second flat plate part 22 regulates the bending of the second articulated part 32, respectively. Therefore, neither the first articulated part 31 nor the second articulated part 32 twists.

In terminal metal fitting 1 in this Embodiment, a width D3 in the third direction X3 of a broad width face 30A of the connecting portion 30 is formed narrower than both a width D1 of the third direction X3 of the broad width face 31A of the first articulated part 31, and a width D2 in the third direction X3 of the broad width face 32A of the second articulated part 32.

Therefore, against bending force around the third direction X3, the connecting portion 30 becomes easier to be bent than the first articulated part 31 and the second articulated part. In other words, a bending position is stable.

In the terminal metal fitting 1 in this Embodiment, each of the broad width faces of the first flat plate part 21, the first articulated part 31, the second flat plate part 22, and the second articulated part 32 includes embossed sections formed by embossing the broad width faces in the respective plate thickness direction thereof.

More concretely, in a −X3 direction for the face 21A, in the +X4 direction for the face 31A, in the −X3 direction for the face 22A, and in the +X5 direction for the face 32A, embossed sections 33, 34 are formed. However, no embossed section is formed on the connecting portion 30.

As shown in FIG. 11, the embossed section 33 is configured including: a bead 33A extending in the first direction X1 formed on the first flat plate part 21, and further extending in the fourth direction X4 perpendicular to the first direction X1; and a bead 33B succeeding to the bead 33A and extending in the third direction X3 formed on the first articulated part 31.

On the other hand, the embossed section 34 is configured including: a bead 34A extending in the second direction X2 formed on the second flat plate part 22, and further extending in the fifth direction X5 perpendicular to the second direction X2; and a bead 34B succeeding to the bead 34A and extending in the third direction X3 formed on the second articulated part 32.

Thereby, in the terminal metal fitting 1 in this Embodiment, against bending force around the third direction X3, the connecting portion 30 becomes easier to be bent than the first flat plate part 21, the first articulated part 31, the second flat plate part 22, and the second articulated part. In other words, a bending position is stable.

Figure 12:
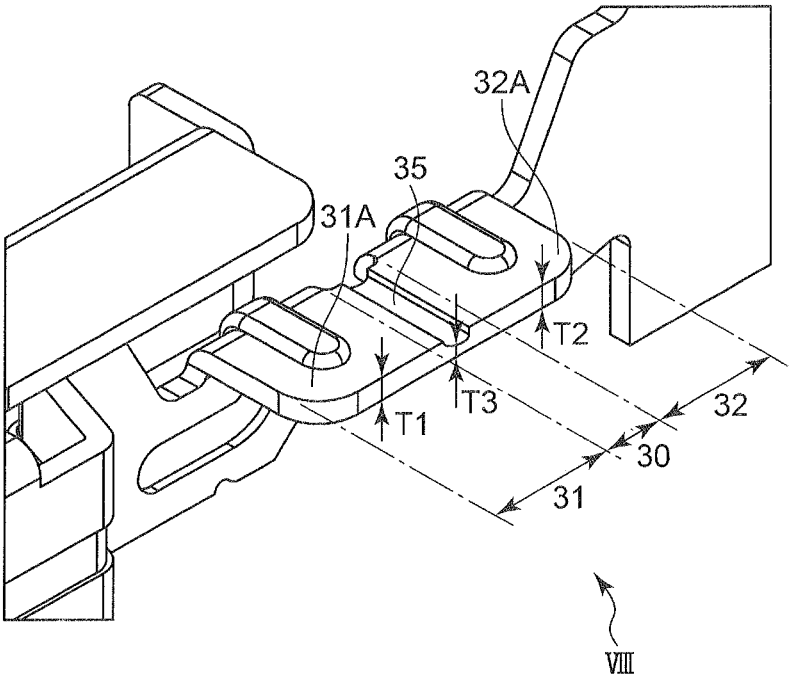
FIG. 12 is an enlarged view of the II section in FIG. 1 showing a connecting portion in another Embodiment.

As shown in FIG. 12, a thickness T3 of the connecting portion 30 may be formed thinner than a thickness T1 of the first articulated part 31, and a thickness T2 of the second articulated part 32, for example, by forming a notch 35 extending in the third direction X3 thereon.

This arrangement causes the flexural strength of the connecting portion 30 around the third direction X3 to be less than both the flexural strength of the first articulated part 31 and the flexural strength of the second articulated part 32 around the same, so that the connecting portion 30 becomes the easiest point to be bent, thereby stabilizing the bending position more.

The notch 35 may be formed on all or a part of the connecting portion 30.

(Embodiment 2)

Next, a terminal metal fitting in another Embodiment according to the present invention will now be described.

Figure 13:
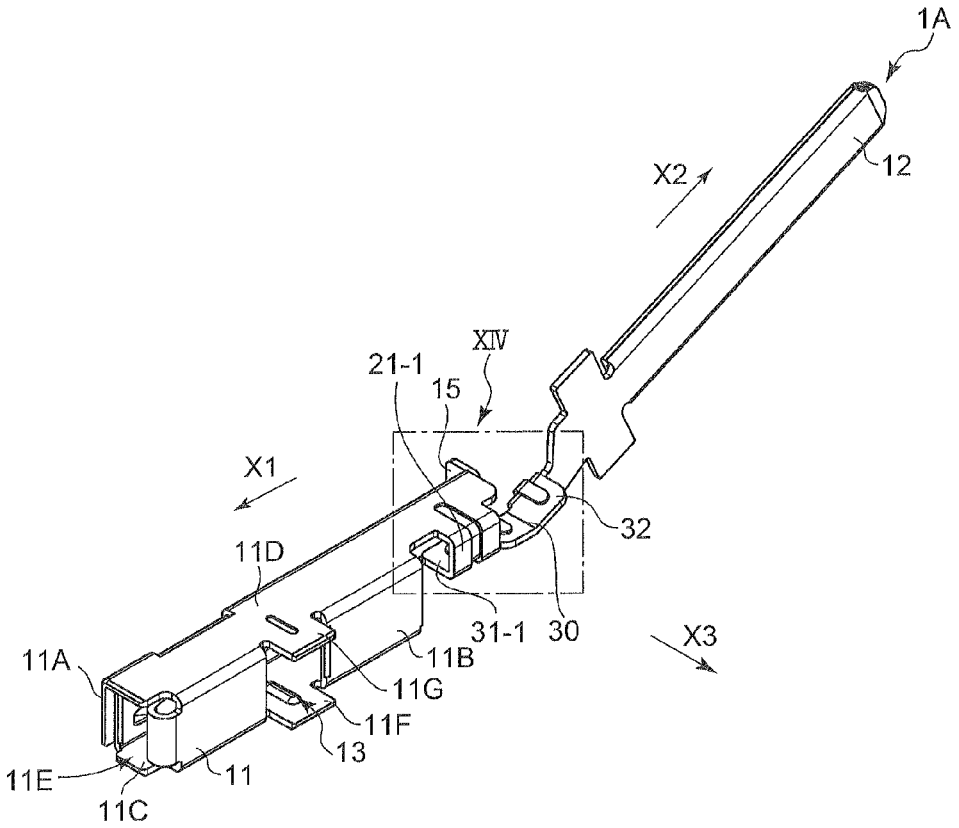
FIG. 13 is a perspective view of a terminal metal fitting in the other Embodiment according to the present invention.
Figure 14:
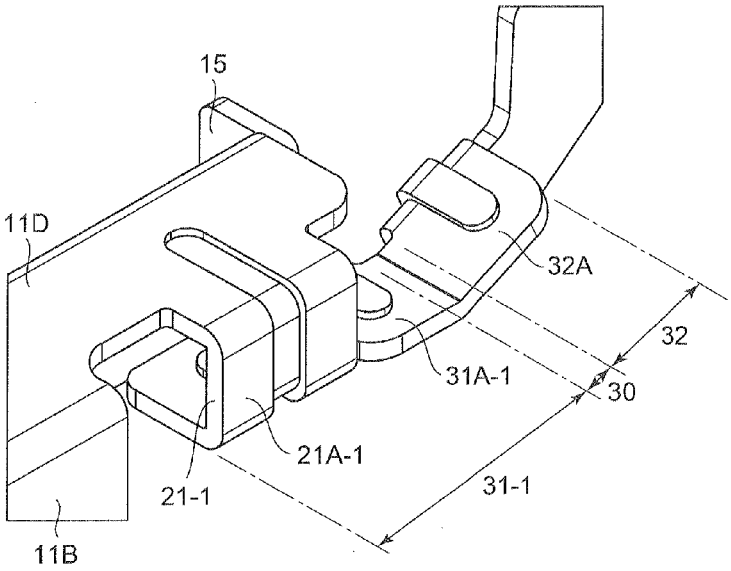
FIG. 14 is an enlarged view of the XIV section in FIG. 13.
Figure 15:
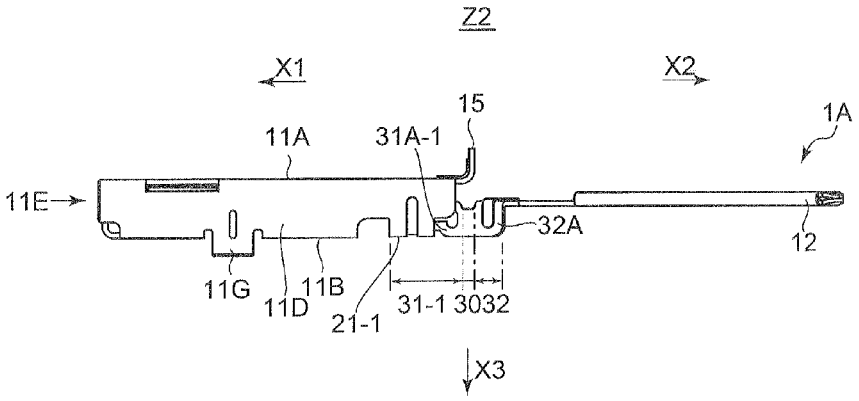
FIG. 15 is a ground plan of the terminal metal fitting of FIG. 13.
Figure 16:
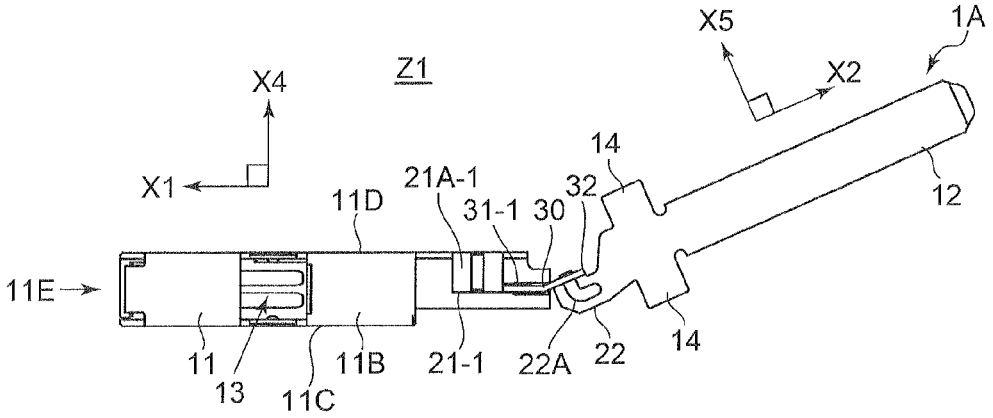
FIG. 16 is a front view of the terminal metal fitting of FIG. 13.
Figure 17:
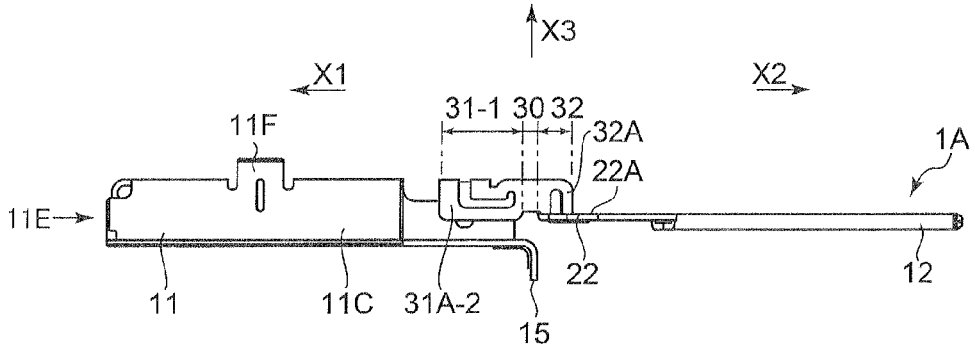
FIG. 17 is a bottom view of the terminal metal fitting of FIG. 13.

FIG. 13 is a perspective view of the terminal metal fitting in the other Embodiment according to the present invention; FIG. 14 is an enlarged view of the XIV section in FIG. 13; FIG. 15 is a ground plan of the terminal metal fitting of FIG. 13; FIG. 16 is a front view of the terminal metal fitting of FIG. 13; and FIG. 17 is a bottom view of the terminal metal fitting of FIG. 13.

In the following explanation, the same symbols are given to the same elements of the above-mentioned terminal metal fitting 1 so as to omit the detailed and duplicated explanation thereof.

A terminal metal fitting 1A shown in from FIG. 13 to FIG. 17, instead of the first flat plate part 21 contacted with the end of the curved portion of the bottom plate 11B of the above-mentioned terminal metal fitting 1, includes a first flat plate part 21-1 contacted with the side of the bottom plate 11B of an end portion of the second terminal 12 of the wall plate 11D.

The first flat plate part 21-1 is of a flat plate type including a broad width face 21A-1 parallel to the bottom plate 11B of the first terminal 11, that is, parallel to the first plane Z1.

As shown in FIG. 16, the broad width face 21A-1 has an approximately half width of that of the bottom plate 11B of the first terminal 11.

Therefore, an end portion of the broad width face 21A-1 toward the −X4 direction is positioned near a central line of the bottom plate 11B of the first terminal 11.

As shown in FIG. 15, the broad width face 21A-1 of the first flat plate part 21-1 extends almost along the bottom plate 11B of the first terminal 11.

An end portion of the broad width face of the first plate part 21-1 toward the −X4 direction is contacted, toward the −X3 direction, with a first articulated part 31-1 including a broad width face 31A-1 extending in the first direction X1.

The broad width face 31A-1 is parallel to the wall plates 11C, 11D of the first terminal 11, that is, parallel to the second plate Z2. As shown in FIG. 17, the broad width face 31A-1 has an approximately half width of that of the wall plate 11C of the first terminal 11.

Therefore, an end portion of the broad width face 31A-1 toward the −X3 direction is positioned near a central line of the wall plate 11 C of the first terminal 11.

In the terminal metal fitting 1A of the above-mentioned structure, dissimilar to the above-mentioned terminal metal fitting 1, one portion where the first flat plate part 21-1 is contacted with the first articulated part 31-1, and another portion where the second flat plate part 22 is contacted with the second articulated part 32 are positioned opposite to each other via the first articulated part 31-1 and the second articulated part 32.

In detail, the first flat plate part 21 and the second flat plate part 22 of the above-mentioned terminal metal fitting 1 are contacted with the first articulated part 31 and the second articulated part 32 in the −X4 and the −X5 directions, which are the same directions.

On the contrary, in the terminal metal fitting 1A of the above-mentioned structure, the −X4 direction contacted with the first articulated part 31-1 of the first flat plate part 21-1 and the +X4 direction contacted with the second articulated part 32 of the second flat plate part 22 are directions opposite to each other. This point differs from the above.

Furthermore, the flat plate part 21 and the second flat plate part 22 of the above-mentioned terminal metal fitting 1 are contacted with the first articulated part 31 and the second articulated part 32 in the same −X3 direction, respectively.

With respect to the terminal metal fitting 1A, one direction (+X3 direction) of the end portion where the first flat plate part 21-1 is contacted with the first articulated part 31-1, and another direction (−X3 direction) of the other end portion where the second flat plate part 22 is contacted with the second articulated part 32 are directions opposite to each other. This point differs from the above.

In the terminal metal fitting 1A above-constructed, similar to the terminal metal fitting 1, upon bending the connecting portion 30 around the third direction X3 (i.e., perpendicularly to the first plane Z1), the first flat plate part 21-1 (having the first broad width face 21A-1 parallel to the first plane Z1) regulates bending of the first articulated part 31-1, and the second flat plate part 22 (having the second broad width face 22A parallel to the first plane Z1) regulates bending of the second articulated part 32.

Therefore, as shown in FIG. 13, this leads not to bend the first and second articulated parts 31-1, 32-1 but to bend the connecting portion 30 connecting the first and second articulated parts 31-1, 32-1.

Also in the terminal metal fitting 1A above-constructed, if external force around at least one of the first and second directions X1, X2 is applied onto at least one of the first and second articulated parts 31-1, 32-1, the first flat plate part 21-1 regulates the bending of the first articulated part 31-1, and the second flat plate part 22 regulates the bending of the second articulated part 32, respectively. Therefore, neither the first articulated part 31-1 nor the second articulated part 32-1 twists.

(Embodiment 3)

Next, a terminal metal fitting in further another Embodiment according to the present invention will now be described.

Figure 18:
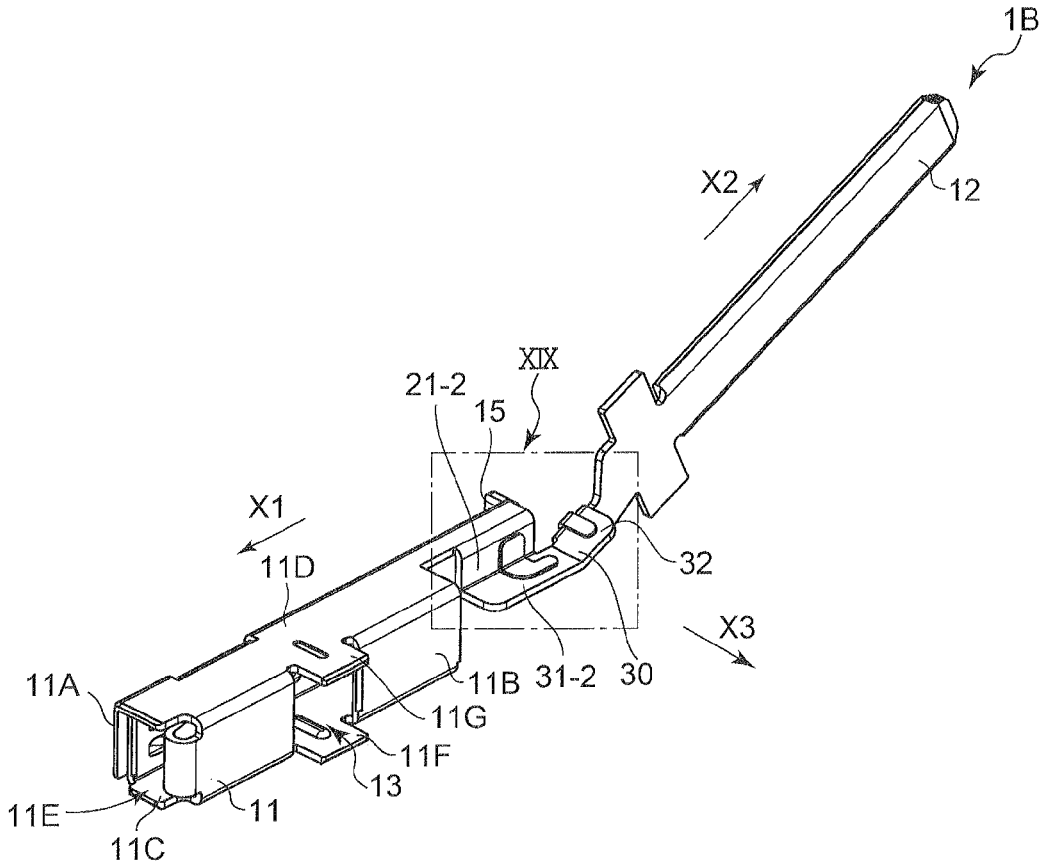
FIG. 18 is a perspective view of a terminal metal fitting in further another Embodiment according to the present invention.
Figure 19:
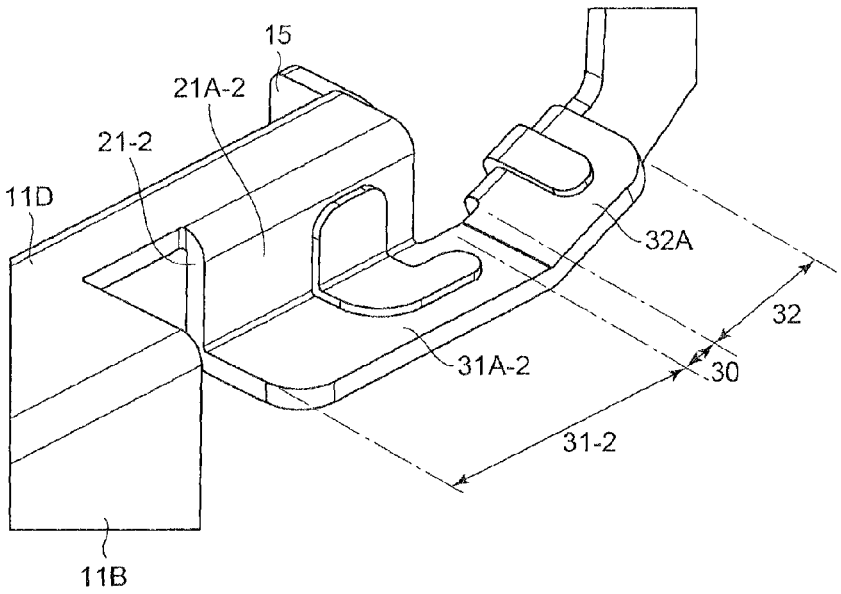
FIG. 19 is an enlarged view of the XIX section in FIG. 18.
Figure 20:
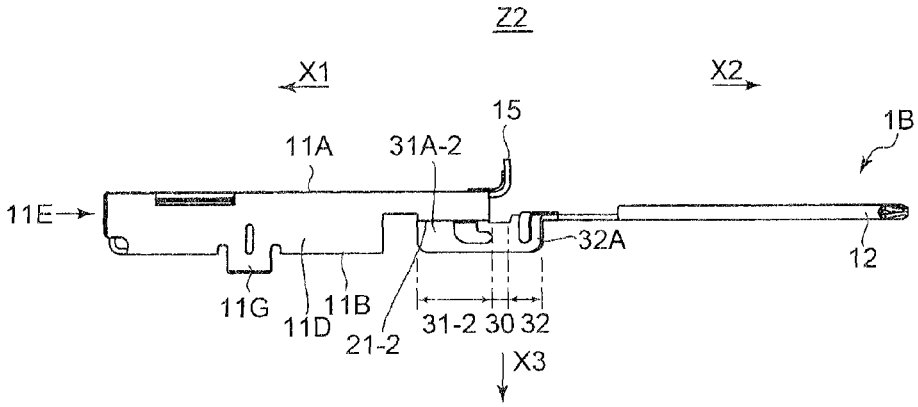
FIG. 20 is a ground plan of the terminal metal fitting of FIG. 18.
Figure 21:
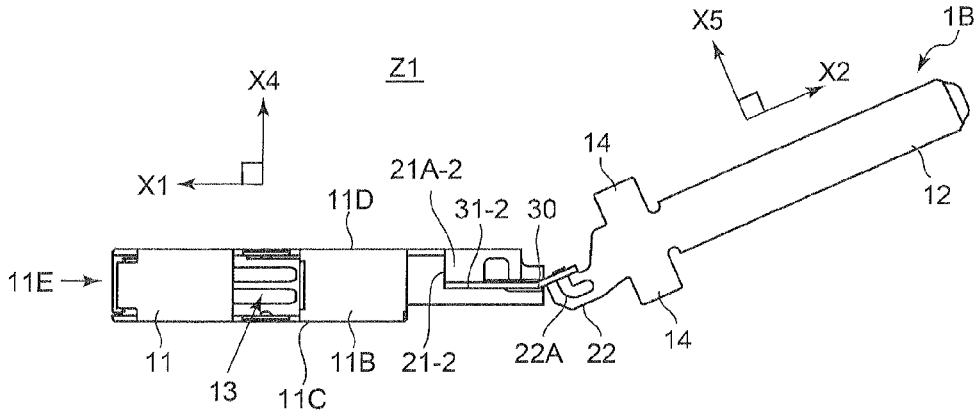
FIG. 21 is a front view of the terminal metal fitting of FIG. 18.
Figure 22:
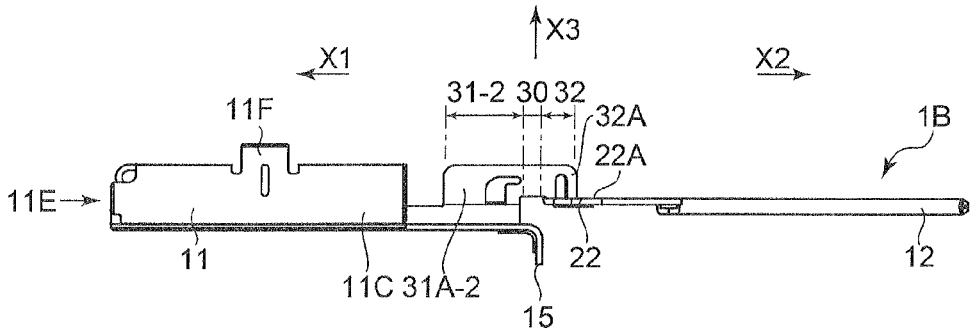
FIG. 22 is a bottom view of the terminal metal fitting of FIG. 18.

FIG. 18 is a perspective view of a terminal metal fitting in further another Embodiment according to the present invention; FIG. 19 is an enlarged view of the XIX section in FIG. 18; FIG. 20 is a ground plan of the terminal metal fitting of FIG. 18; FIG. 21 is a front view of the terminal metal fitting of FIG. 18; and FIG. 22 is a bottom view of the terminal metal fitting of FIG. 18.

In the following explanation, the same symbols are given to the same elements of the above-mentioned terminal metal fitting 1 so as to omit the detailed and duplicated explanation thereof.

A terminal metal fitting 1B shown in from FIG. 18 to FIG. 22, instead of the first flat plate part 21 contacted with the end of the curved portion of the bottom plate 11B of the above-mentioned terminal metal fitting 1, includes a first flat plate part 21-2 contacted with the side of the bottom plate 11B of an end portion of the second terminal 12 of the wall plate 11D.

The first flat plate part 21-2 is of a flat plate type including a broad width face 21A-2 parallel to the bottom plate 11B of the first terminal 11, that is, parallel to the first plane Z1.

As shown in FIG. 21, the broad width face 21A-2 has an approximately half width of that of the bottom plate 11B of the first terminal 11.

Therefore, an end portion of the broad width face 21A-2 toward the −X4 direction is positioned near a central line of the bottom plate 11B of the first terminal 11.

As shown in FIG. 20, the broad width face 21A-2 of the first flat plate part 21-2 is positioned near the central line of the wall plate 11D of the first terminal 11.

An end portion of the broad width face 21A of the first plate part 21-2 toward the −X4 direction is contacted, toward the +X3 direction, with a first articulated part 31-2 including a broad width face 31A-2 extending in the first direction X1.

The broad width face 31A-2 is parallel to the wall plates 11C, 11D of the first terminal 11, that is, parallel to the second plate Z2.

An end portion of the broad width face 31 A-2 toward the +X3 direction extends along the bottom plate 11B of the first terminal 11.

In the terminal metal fitting 1B, dissimilar to the above-mentioned terminal metal fitting 1, when the first articulated part 31-2 and the second articulated part 32 are parallel to each other, one direction from an end portion where the first plate part 21-2 is contacted with the first articulated part 31-2 to an end portion where the first plate part 21-2 is not contacted with the first articulated part 31-2, and another direction from an end portion where the second plate part 22 is contacted with the second articulated part 32 to an end portion where the second plate part 22 is not contacted with the second articulated part 32, are opposite to each other.

In detail, the first flat plate part 21 and the second flat plate part 22 of the above-mentioned terminal metal fitting 1 are contacted with the first articulated part 31 and the second articulated part 32 in the −X4 and −X5 directions, which are the same directions.

On the contrary, in the terminal metal fitting 1B of the above-mentioned structure, the +X4 direction contacted with the first articulated part 31-2 of the first flat plate part 21-2 and the −X5 direction contacted with the second articulated part 32 of the second flat plate part 22 are directions opposite to each other. This point differs from the above.

In addition, in this terminal metal fitting 1B, similar to the above-mentioned terminal metal fitting 1, the first flat plate part 21-2 and the second flat plate part 22 are contacted with the end portions toward the −X3 direction of the first articulated part 31-2 and the second articulated part 32, respectively.

Also in the terminal metal fitting 1B above-constructed, similar to the terminal metal fitting 1, upon bending the connecting portion 30 around the third direction X3 (i.e., perpendicularly to the first plane Z1), the first flat plate part 21-2 (having the first broad width face 21A-2 parallel to the first plane Z1) regulates bending of the first articulated part 31-2, and the second flat plate part 22 (having the second broad width face 22A parallel to the first plane Z1) regulates bending of the second articulated part 32.

Therefore, as shown in FIG. 18, this leads not to bend the first and second articulated parts 31-2, 32-2 but to bend the connecting portion 30 connecting the first and second articulated parts 31-2, 32-2.

Also in the terminal metal fitting 1B above-constructed, if external force around at least one of the first and second directions X1, X2 is applied onto at least one of the first and second articulated parts 31-2, 32, the first flat plate part 21-2 regulates the bending of the first articulated part 31-2, and the second flat plate part 22 regulates the bending of the second articulated part 32, respectively. Therefore, neither the first articulated part 31-2 nor the second articulated part 32 twists.

(Embodiment 4)

Next, a connector using the above-mentioned terminal metal fitting 1 will now be explained.

Figure 23:
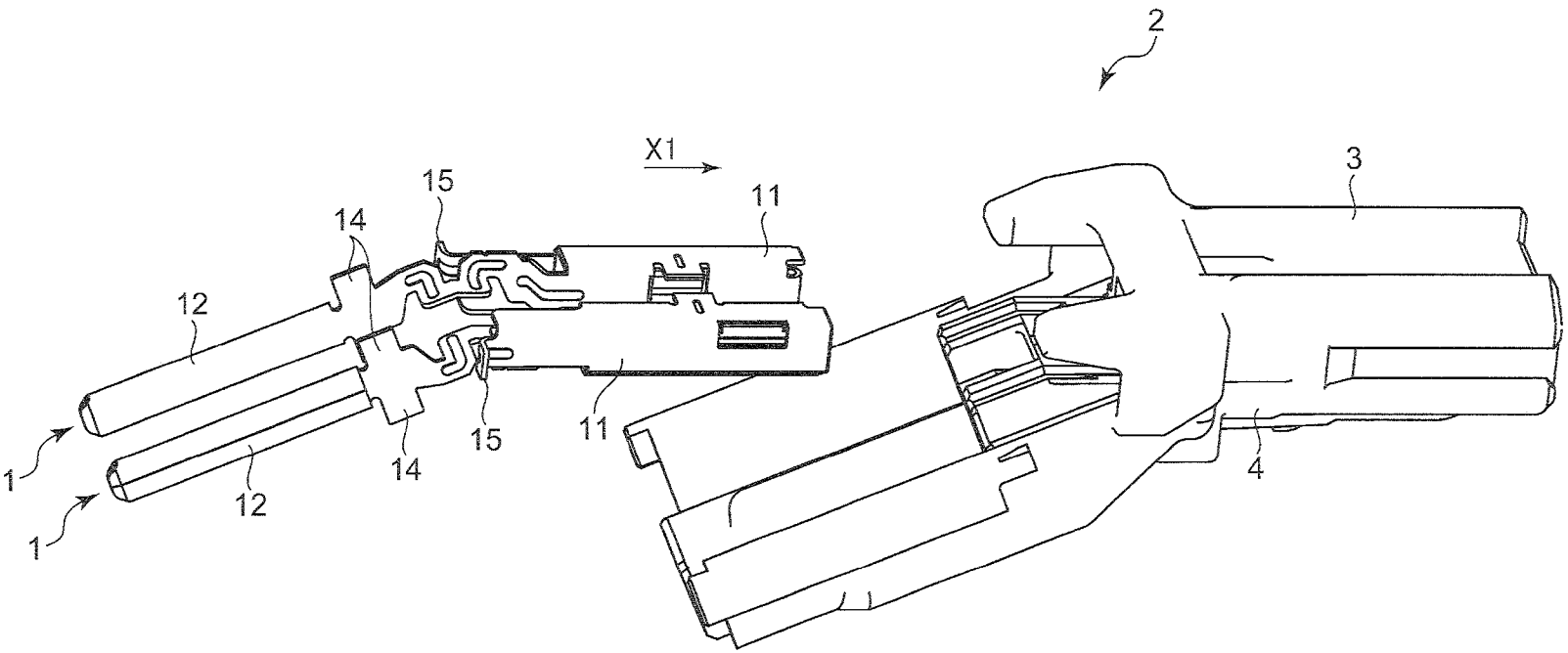
FIG. 23 is a perspective view showing a process of inserting the terminal metal fitting into the housing.
Figure 24:
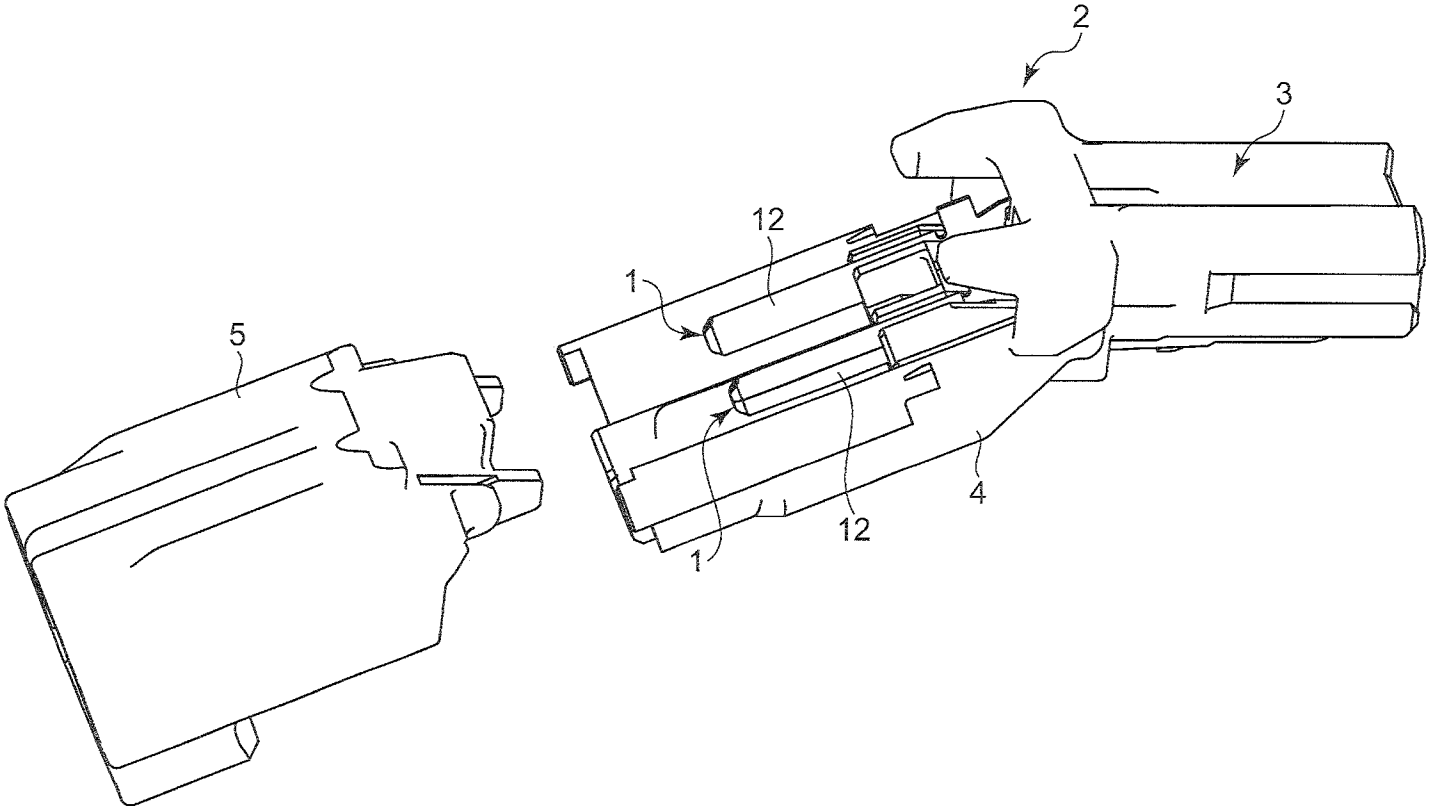
FIG. 24 is a perspective view showing a process of attaching a cover to the housing into which the terminal metal fitting has been inserted.
Figure 25:
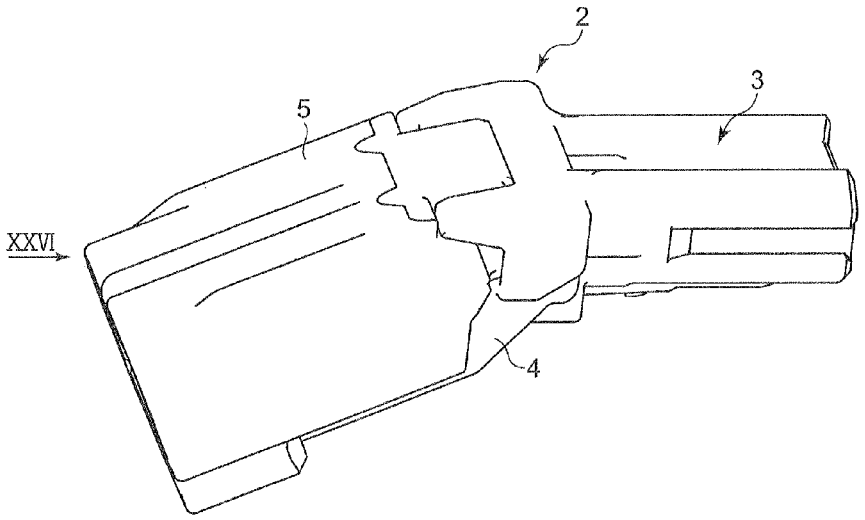
FIG. 25 is a perspective view of a connector to which the cover has been attached.
Figure 26:
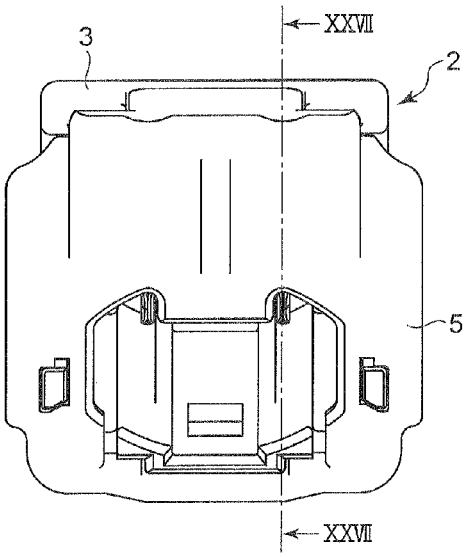
FIG. 26 is a perspective view from the XXVI section in FIG. 25.
Figure 27:
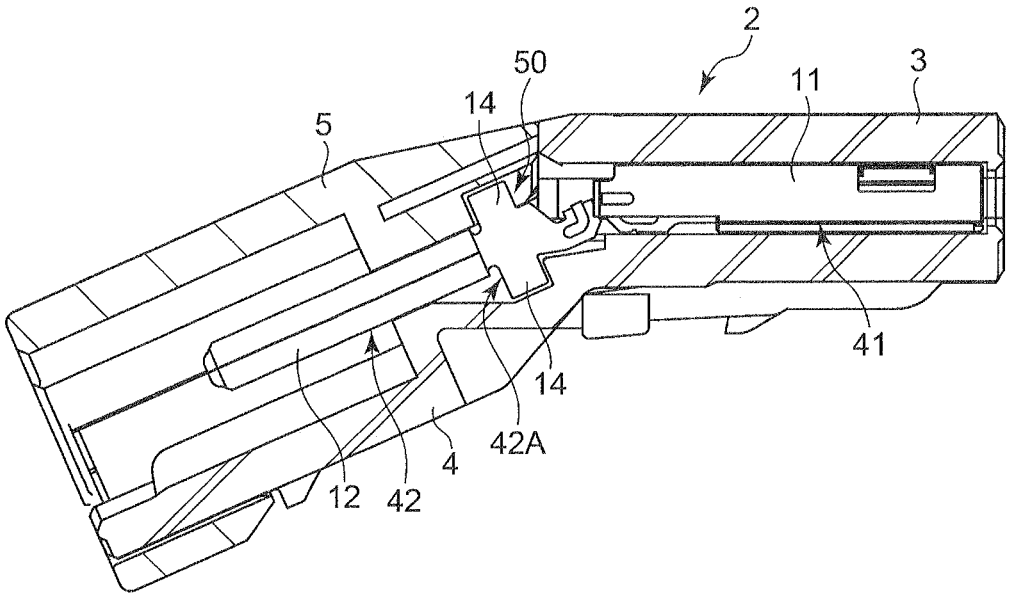
FIG. 27 is a sectional view according to the XXVII-XXVII section in FIG. 26.
Figure 28:
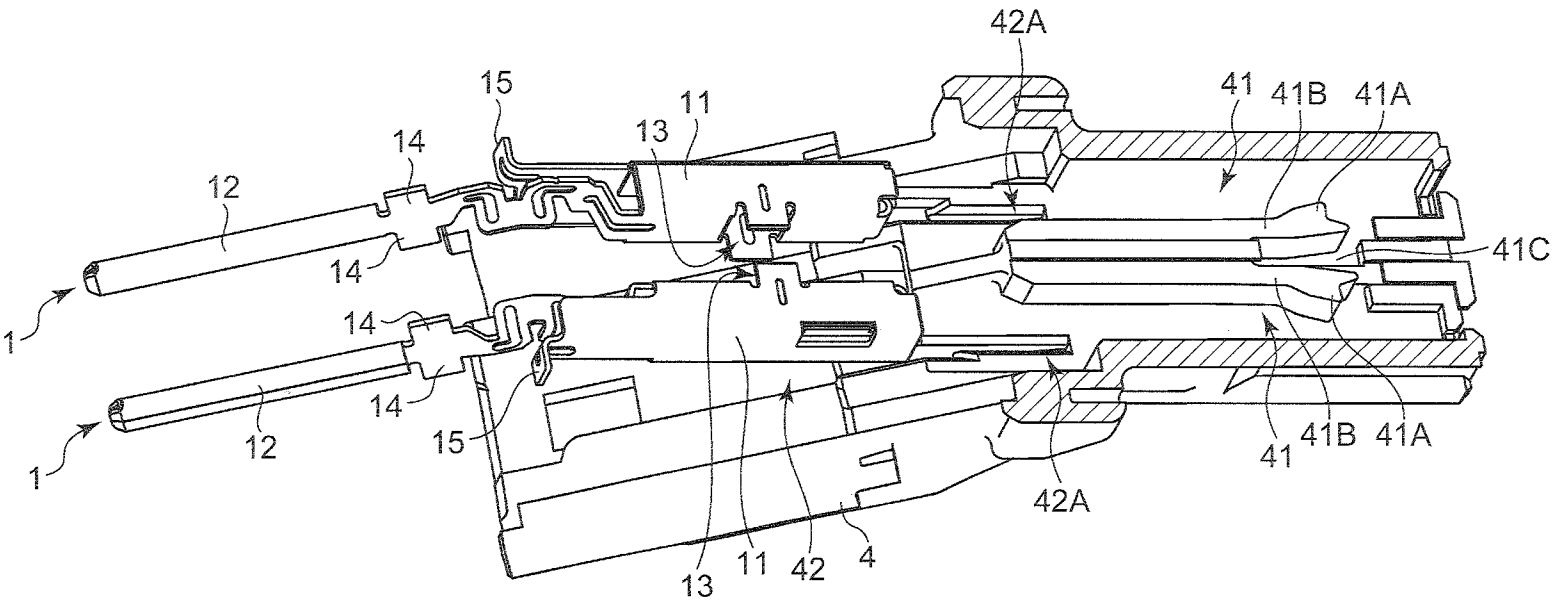
FIG. 28 is a sectional view of the housing upon inserting the terminal metal fitting into the housing.
Figure 29:
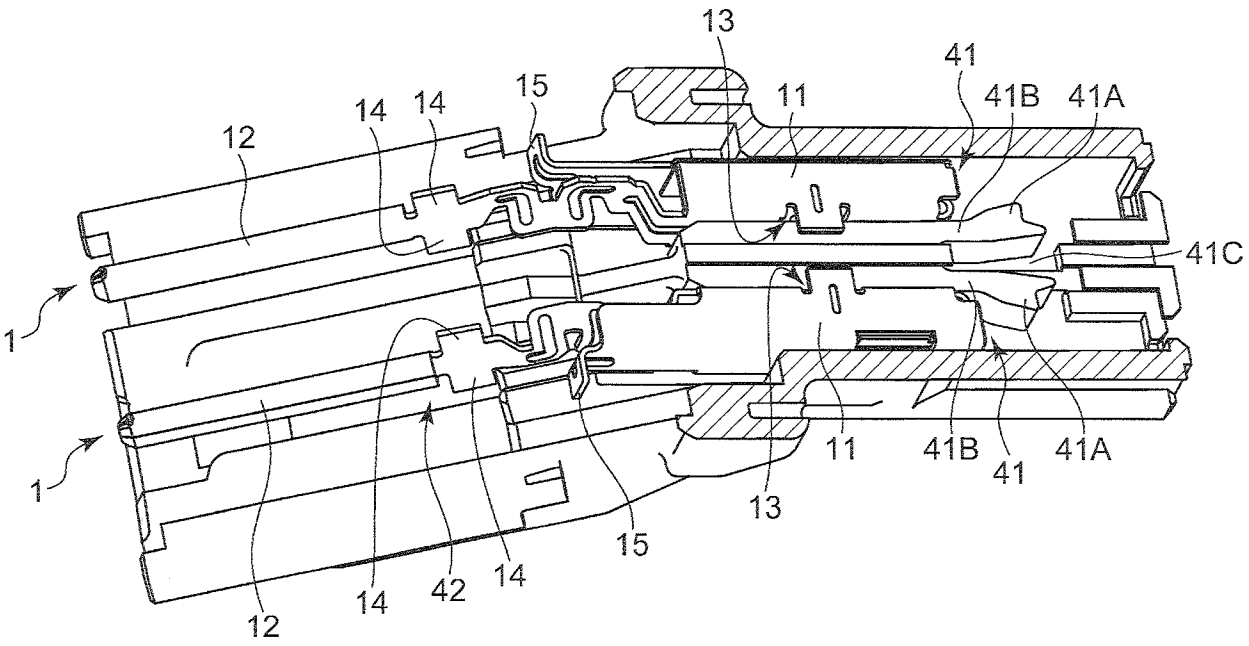
FIG. 29 is a sectional view of the housing upon inserting the terminal metal fitting into the housing.
Figure 30:
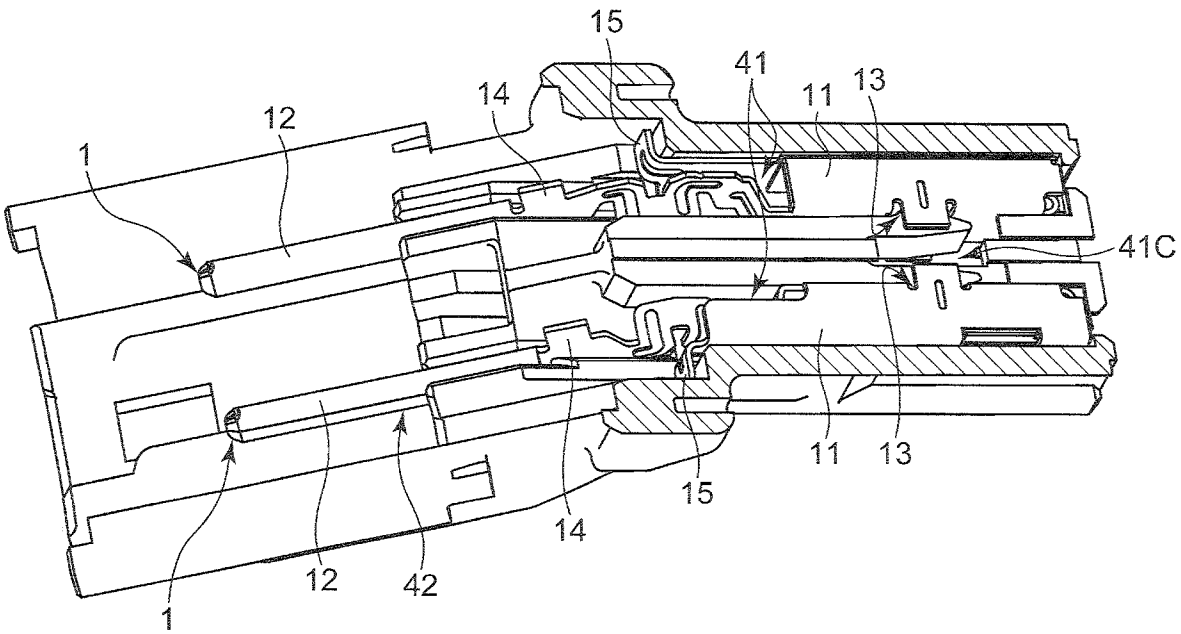
FIG. 30 is a sectional view of the housing upon inserting the terminal metal fitting into the housing.

FIG. 23 is a perspective view showing a process of inserting the terminal metal fitting into the housing; FIG. 24 is a perspective view showing a process of attaching a cover to the housing into which the terminal metal fitting has been inserted; FIG. 25 is a perspective view of a connector to which the cover has been attached; FIG. 26 is a perspective view from the XXVI section in FIG. 25; FIG. 27 is a sectional view according to the XXVII-XXVII section in FIG. 26; FIG. 28 to FIG. 30 are sectional views of the housing upon inserting the terminal metal fitting into the housing.

A connector 2 shown in from FIG. 23 to FIG. 25 is configured by arranging, in the third X3 direction, two sets of the terminal metal fittings 1,1 are arranged in a manner such that two recessed portions 13, 13 (See, FIG. 30.) thereof face to each other so as to be stored in the housing 3.

As shows in FIG. 6 and FIG. 7, one of the terminal metal fittings 1, 1 is bent in the counterclockwise direction around the third direction X3. And, as shows in FIG. 8 and FIG. 9, the other of the terminal metal fittings 1, 1 is bent in the clockwise direction around the third direction X3.

In the terminal metal fittings 1, 1 used herein, the first articulated part 31 is positioned on the central line of the width D4 in the fourth direction X4 perpendicular to the first direction X1 on the first plane Z1 of the first terminal 11, and the second articulated part 32 is positioned on the central line of the width D5 in the fifth direction X5 perpendicular to the second direction X2 on the first plane Z1 of the second terminal 12.

By means of the terminal metal fitting 1, the connecting portion 30 can be bent in one direction and the other direction around the third direction X3 so as to form the angle differences between the first and second directions X1, X2. If the one formed angle difference between the first and second directions X1, X2, and the other formed angle difference between the first and second directions X1, X2 are the same, the second distal end position of the second terminal 12 based on the first distal end position of the first terminal 11 is linearly symmetrical with the central line of the width of the first terminal 11 in the fifth direction X4.

As shown in FIG. 23, arranging the recessed portions 13, 13 of the terminal metal fittings 1, 1 opposing to each other to have the same bending direction causes the distal ends of the second terminals 12, 12 to have the same positions based on the distal ends of the first terminals 11, 11.

The housing 3 is of a two-split type which can be separated into a housing body 4 and a cover 5.

The housing body 4 includes: a first housing portion 41 (See, FIG. 28.) in which a receiving hole storing the first terminal 11 of the terminal metal fitting 1 is formed so as to hide thereof entirely; and a second housing portion 42 in which a storing groove storing the second terminal 12 of the terminal metal fitting 1 is formed so as to hide a part thereof.

Two sets of the first housing portions 41, 41 and the second housing portions 42, 42 are symmetrically formed in the third direction X3.

The first housing portions 41, 41 and the second housing portions 42, 42 are not on a straight line, and are formed to have predetermined angle differences therebetween.

As shown in FIG. 23, the first terminal 11 of the terminal metal fitting 1 is inserted into the first housing portion 41 in the first direction X1.

As shown in FIG. 24, in a state where the first terminal 11 has been inserted into the first housing portion 41, the second terminal 12 is stored by the second housing portion 42 such that a part of the second terminal 12 is hidden thereby.

As shown in FIG. 25, the cover 5 covers the second terminal 12 of the terminal metal fitting 1 exposed from the second housing portion 42, and holds the terminal metal fitting 1 within the housing body 4.

As shown in from FIG. 28 to FIG. 30, in the first housing portion 41 of the housing body 4, a lance (projection) 41A as a first engaged portion engaged with the recessed portion 13 is provided upon the first terminal 11 being inserted in the first housing portion 41 of the housing body 4.

The lance 41A is elastically supported by a flexible portion 41B capable of bending to separate from an inner wall of the first housing portion 41.

As shown in FIG. 28 and FIG. 29, when the first terminal 11 of the terminal metal fitting 1 is inserted into the first housing portion 41 in the first direction X1 and the distal end of the first terminal 11 abuts onto the lance 41A, the flexible portion 41B bends to make the lance 41A evacuate into an evacuation space 41C.

After that, when the first terminal 11 has reached an engagement position shown in FIG. 30, the lance 41A returns to an original position thereof to be engaged with the recessed portion 13.

Due to this, the first terminal 11 cannot be pulled out from the housing portion 41. In this Embodiment, two sets of the first housing portions 41, 41 and the second housing portions 42, 42 are symmetrically formed in the third direction X3, and the lances 41A, 41A are arranged back to back.

Accordingly, the evacuation space 41C for the lances 41A, 41A can be commoditized, thereby enabling miniaturization of the connector 2.

On the other hand, a recessed groove 42A as a second engaged portion being engaged with a part of the projection portion 14 of the second terminal 12 is provided with the second housing portion 42 of the housing body 4.

The recessed groove 42A is formed such that the projection portion 14 of the second terminal is not caught by the housing body 4 when the first terminal 11 of the terminal metal fitting 1 is inserted into the first housing portion 41 in the first direction X1.

As shown in FIG. 27, a distal end portion of the recessed groove 42A in the first direction X1 is formed such that the second terminal 12 dose not further advance in the first direction X1 in a state where the first terminal 11 is located at the engagement position.

A recessed groove 50 is formed on the cover 5. The projection portion 14 of the second terminal 12 enters the recessed groove 50 when the second terminal 12 stored within the second housing portion 42 of the housing body 4 is attached onto the housing body 4.

The recessed groove 50 is formed so as to clamp the projection portion 14 of the second terminal 12 with the recessed groove 42A upon the cover 5 having been attached onto the housing body 4.

In the connector 2 constructed above, when the first terminal 11 of the terminal metal fitting 1 is inserted into the first housing portion 41 of the housing body 4 in the first direction X1, the recessed portion 13 of the first terminal 11 is engaged with the lance 41A of the first housing portion 41, as well as, the part of the second terminal 12 of the terminal metal fitting 1 is stored within the second housing portion 42 of the housing body 4, and the part of the projection portion 14 of the second terminal 12 is engaged with the recessed groove 42A of the second housing portion 42.

Herein, pressing in the first direction X1 the pressing part 15 equipped with the first terminal 11 of the terminal metal fitting 1 causes the pushing force upon inserting the terminal metal fitting 1 into the first housing portion 41 to apply onto the first terminal 11.

Accordingly, the connecting portion 30 can be prevented from being deformed.

Since the cover 5 covers the second terminal 12 exposed from the second housing portion 42, the projection portion 14 of the second terminal 12 is clamped by both the recessed groove 50 and the recessed groove 42A, thereby holding the projection portion 14 of the second terminal 12.

Due to this, the connector including the housing 3 storing the terminal metal fitting 1 having the angle difference between one extending direction of the first terminal 11 and another extending direction of the second terminal 12 can be obtained.

In the terminal metal fitting 1 according to this Embodiment, regardless of one and another directions around the third direction X3 in which the connecting portion 30 is bent, a plurality of terminal metal fittings 1, 1 are arranged such that the plurality of terminal metal fittings are bent in the same direction, the second distal end positions of the second terminals 12, 12 can have the same positions based on the first distal end positions of the first terminals 11, 11.

Therefore, the plurality of terminal metal fittings 1, 1 can be used regardless of the one and the other directions.

In other words, communalization (standardization) of the terminal metal fittings 1, 1 can be performed.

Figure 31:
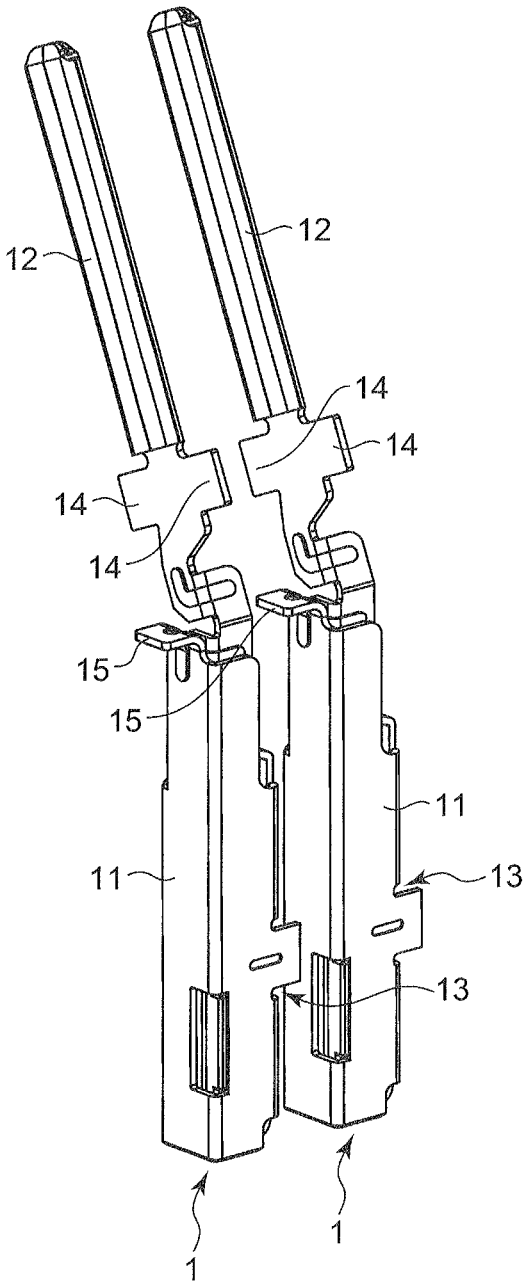
FIG. 31 is a perspective view of another arrangement example of the terminal metal fitting.
Figure 32:
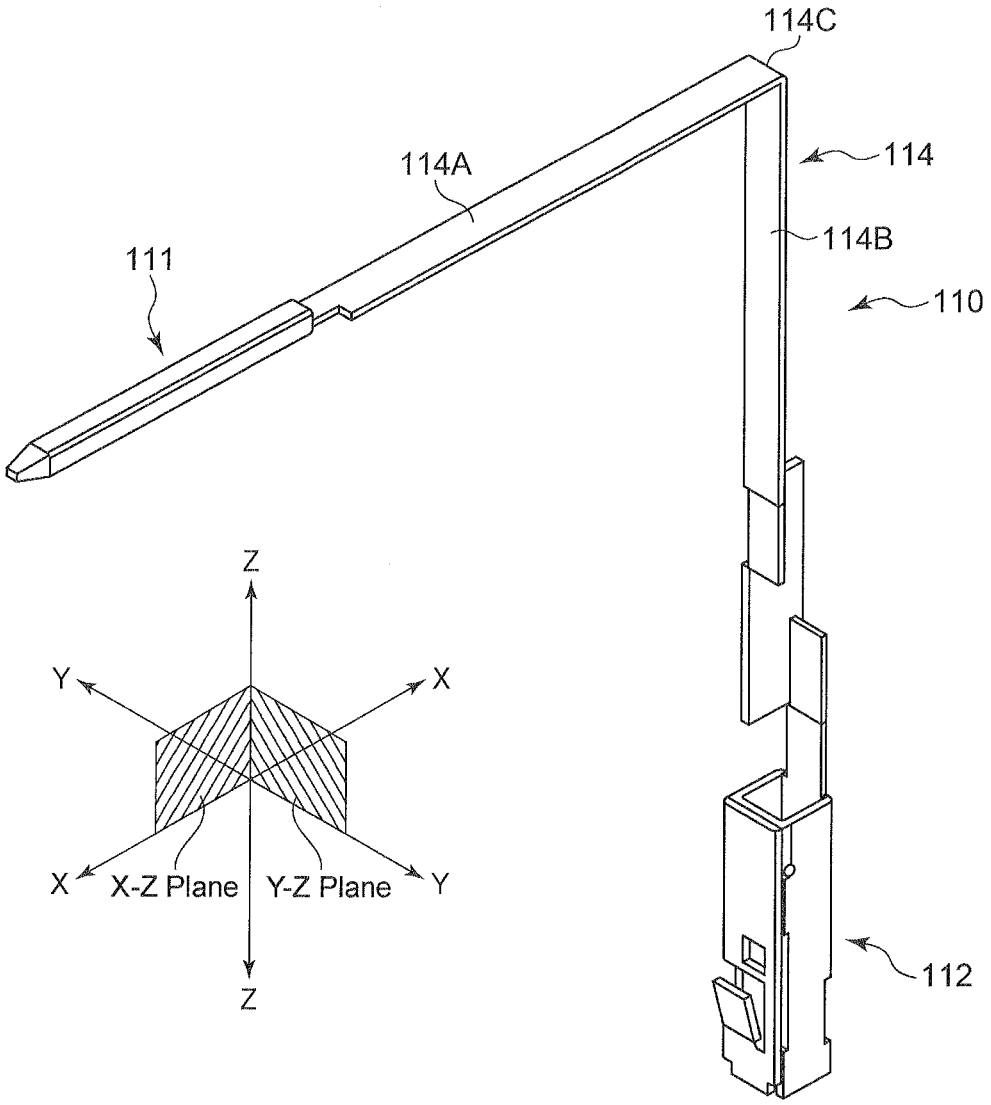
FIG. 32 PRIOR ART
FIG. 32 is a perspective view of a terminal metal fitting disclosed in Reference 1.

In this Embodiment, the composition according to arrangement in which the terminal metal fittings 1, 1 are bent in the directions opposed to each other has been shown. Alternatively, as shown in FIG. 31, however, the terminal metal fittings 1, 1 may be bent in the same direction.

If so, two sets of terminal metal fittings 1, 1, each of which includes the first housing portion 41 and the second housing portion 42 of the housing 3 having the same shapes in the third direction X3, may be arranged to be formed.

Of course, it is also conceivable to arrange three or more sets of the terminal metal fittings 1, 1 within the housing 3.

Needless to say, the terminal metal fitting 1A and/or the terminal metal fitting 1B can be used in the same manner as that of the terminal metal fitting 1, instead thereof.

In the Embodiments mentioned above, the first terminal 11 is a female terminal and the second terminal 12 is a male terminal. The scope of the present invention is never limited to this.

For example, the first terminal 11 may be a male terminal and the second terminal 12 may be a female terminal.

Alternatively, for example, both the first terminal 11 and the second terminal 12 may be male terminals, and both the first terminal 11 and the second terminal 12 may be female terminals.

INDUSTRIAL APPLICABILITY

The terminal metal fitting according to the present invention, and the connector using the same is preferably applicable as a terminal metal fitting and a connector used for electrically connecting various devices mounted on an automobile and so on, especially, as a terminal metal fitting and a connector having terminals at the both ends, capable of being easily bent precisely in position to be bent.

BRIEF DESCRIPTION OF SYMBOLS

1, 1A, and 1B: Terminal metal fitting
2: Connector
3: Housing
4: Housing body
5: Cover
11: First terminal
11A: Top plate
11B: Bottom plate
11C and 11D: Wall plate
11E: Opening
11F and 11G: Protrusion plate
12: Second terminal
13: Recessed portion
14: Projection portion
15: Pressing part
21, 21-1, and 21-2: First flat plate part
22: Second flat plate part
30: Connecting portion
31, 31-1, and 31-2: First articulated part
32: Second articulated part
33 and 34: Embossed section
33A, 33B, 34A, and 34B: Bead
35: Notch
41: First housing portion
41A: Lance
41B: Flexible portion
41C: Evacuation space
42: Second housing portion
42A: Recessed groove
50: Recessed groove

What is claimed is:

1. A terminal metal fitting, comprising:

a first terminal extended in a first direction on a first plane;

a second terminal extended in a second direction on the first plane;

a first flat plate part being contacted with the first terminal, having a first broad width face parallel to the first plane, and being engaged with a housing so as to be stored thereby;

a second flat plate part being contacted with the second terminal, having a second broad width face parallel to the first plane, and being engaged with the housing so as to be stored thereby;

a first articulated part being contacted with the first flat plate part in the first direction, and having a third broad width face parallel to a second plane including a third direction perpendicular to the first plane, and the first direction;

a second articulated part being contacted with the second flat plate part in the second direction, and having a fourth broad width face parallel to a third plane including the second direction and the third direction; and a connecting portion connecting the first articulated part and the second articulated part, wherein:

the connection portion is bent at an obtuse angle around the third direction to form an angle difference between the first direction and the second direction; and each of the first flat plate part, the first articulated part, the second flat plate part, and the second articulated part includes an embossed section formed in the respective plate thickness direction thereof, whereas the connecting portion includes no embossed section such that, against bending force around the third direction, the connecting portion is more easily bendable than the first flat plate part, the first articulated part, the second flat plate part, and the second articulated part.

2. The terminal metal fitting as defined in claim 1, wherein a width of the connecting portion in the third direction is narrower than both a width of the first articulated part in the third direction, and a width of the second articulated part in the third direction.

3. The terminal metal fitting as defined in claim 1, wherein a plate thickness of the connecting portion is thinner than both a plate thickness of the first articulated part, and a plate thickness of the second articulated part.

4. The terminal metal fitting as defined in claim 1, wherein each of the first, second, third, and fourth broad width faces of the first flat plate part, the first articulated part, the second flat plate part, and the second articulated part except the connecting portion includes an embossed section formed by embossing each of the first, second, third, and fourth broad width faces in the respective plate thickness directions thereof.

5. The terminal metal fitting as defined in claim 1, wherein:

on the first plane of the first terminal, the first articulated part is on a central line of a width in a fourth direction perpendicular to the first direction; and on the first plane of the second terminal, the second articulated part is on a central line of a width in a fifth direction perpendicular to the second direction.

6. The terminal metal fitting as defined in claim 1, wherein:

a first portion is a portion where the first flat plate part is contacted with the first articulated part;

a second portion is another portion where the second flat plate part is contacted with the second articulated part; and the first and second portions are opposite to each other via the first articulated part and the second articulated part.

7. The terminal metal fitting as defined in claim 1, wherein:

a first end is an end of a side where the first flat plate part is contacted with the first articulated part;

a second end is an end of another side where the first flat plate part is not contacted with the first articulated part;

a third end is an end of a side where the second flat plate part is contacted with the second articulated part;

a fourth end is an end of another side where the second flat plate part is not contacted with the second articulated part; and upon the first articulated part and the second articulated part being in a parallel state, a first parallel direction from the first end to the second end and a second parallel direction from the third end to the fourth end are opposite to each other.

8. A connector, comprising:

the terminal metal fitting as defined in claim 1; and a housing storing the terminal metal fitting therein.

9. The connector as defined in claim 8, wherein:

the terminal metal fitting includes: a first engaging portion engaged with the housing on the first terminal; and a second engaging portion engaged with the housing on the second terminal, respectively;

the housing comprises:

a first housing portion, upon the first terminal having been inserted into the first housing portion in the first direction, storing the first terminal of the terminal metal fitting so as to entirely hide thereof, and the first housing portion including a first engaged portion engaged with the first engaging portion of the first terminal;

a second housing portion storing the second terminal of the terminal metal fitting so as to hide a part of the second terminal, and the second housing portion including a second engaged portion engaged with a part of the second engaging portion of the second terminal; and a cover covering the second terminal exposed from the second housing portion, and the cover clamping the second engaging portion of the second terminal with the second engaged portion to hold the second engaging portion of the second terminal.

10. The connector as defined in claim 9, wherein the housing therein stores a plurality of devices arranged in the third direction, each of the plurality of devices being the terminal metal fitting.

11. The connector as defined in claim 9, wherein a pressing part is provided with the first terminal of the terminal metal fitting, the pressing part, upon inserting the first terminal into the first housing portion, pressing the first terminal in the first direction.

* * * * *